US007840411B2

(12) United States Patent
Hotho et al.

(10) Patent No.: US 7,840,411 B2
(45) Date of Patent: Nov. 23, 2010

(54) AUDIO ENCODING AND DECODING

(75) Inventors: Gerard Herman Hotho, Eindhoven (NL); Francois Philippus Myburg, Eindhoven (NL); Arnoldus Werner Johannes Oomen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 653 days.

(21) Appl. No.: 11/909,742

(22) PCT Filed: Mar. 16, 2006

(86) PCT No.: PCT/IB2006/050826

§ 371 (c)(1),
(2), (4) Date: Sep. 26, 2007

(87) PCT Pub. No.: WO2006/103586

PCT Pub. Date: Oct. 5, 2006

(65) Prior Publication Data

US 2010/0153118 A1 Jun. 17, 2010

(30) Foreign Application Priority Data

Mar. 30, 2005 (EP) ..... 05102515
Apr. 18, 2005 (EP) ..... 05103085
Jan. 11, 2006 (EP) ..... 06100245

(51) Int. Cl.
*G10L 19/00* (2006.01)
*G10L 21/04* (2006.01)

(52) U.S. Cl. ..... 704/500; 704/501; 704/503; 704/E19.001; 704/E19.005; 704/E21.017

(58) Field of Classification Search ..... 704/500, 704/501, 503, 504, E19.001, E19.005, E21.017
See application file for complete search history.

(56) References Cited

U.S. PATENT DOCUMENTS 5,946,352 A * 8/1999 Rowlands et al. ..... 375/242

(Continued)

OTHER PUBLICATIONS

Baumgarte "Efficient representation of spatial Audio using Perceptual Parametrization" IEEE Workshop on Application of Signal Processing to audio and Acoustics, new Paltz, New York, 2001, pp. 1-4.*

(Continued)

*Primary Examiner*—David R Hudspeth
*Assistant Examiner*—Abdelali Serrou

(57) ABSTRACT

A multi-channel audio encoder (10) encodes an N-channel audio signal. A first unit (110) generates a first encoded M-channel signal, e.g. a spatial stereo down-mix, for the N-channel signal (N>M). Down-mixers (115, 116, 117) generate first enhancement data for the signal relative to the N-channel audio signal. A second M-channel signal, such as an artistic stereo mix, is generated for the N-channel signal. A processor (123) then generates second enhancement data for the second M-channel signal relative to the first M-channel signal. A second unit (120) generates an output signal comprising the second M-channel signal, the first enhancement data and the second enhancement data. The generator (123) can dynamically select between generating the second enhancement data as absolute enhancement data or as relative enhancement data relative to the second encoded M-channel signal. A decoder (20) can perform the inverse operation and can apply the second enhancement data as absolute or relative enhancement depending on an indication in the received bitstream.

30 Claims, 7 Drawing Sheets

U.S. PATENT DOCUMENTS

| | | | | |
|---|---|---|---|---|
| 6,122,619 | A * | 9/2000 | Kolluru et al. | 704/500 |
| 6,205,430 | B1 * | 3/2001 | Hui | 704/500 |
| 6,341,165 | B1 * | 1/2002 | Gbur et al. | 381/23 |
| 6,539,357 | B1 * | 3/2003 | Sinha | 704/270.1 |
| 7,263,480 | B2 * | 8/2007 | Minde et al. | 704/219 |
| 7,394,903 | B2 * | 7/2008 | Herre et al. | 381/23 |
| 7,447,317 | B2 * | 11/2008 | Herre et al. | 381/23 |
| 2006/0009225 | A1 * | 1/2006 | Herre et al. | 455/450 |
| 2006/0153408 | A1 * | 7/2006 | Faller et al. | 381/307 |

OTHER PUBLICATIONS

Bosi "Multichannel Audio Coding[1] and Its Applications in DAB and DVB", Signal Processing Proceding, 2000, WCCC-ICSP 2000, 5th International conference, vol. 1, pp. 1-10.*

Herre et al; "MP3 Surround: Efficient and Compatible Coding of Multi Channel Audio"; Audio Engineering Society Convention Paper, New York, NY, May 8, 2004, pp. 1-14,XP002350798.

Faller et al: "Binaural Cue Coding Part II: Schemes and Applications", IEEE Transactions on Speech and Audio Processing; IEEE Service Center, New York, vol. 11, No. 6, Oct. 6, 2003, pp. 520-531,, XP002338415.

* cited by examiner

AUDIO ENCODING AND DECODING

The invention relates to audio encoding and/or decoding for multi-channel signals.

A multi-channel audio signal is an audio signal having two or more audio channels. Well-known examples of multi-channel audio signals are two-channel stereo audio signals and 5.1 channel audio signals having two front audio channels, two rear audio channels, one center audio signal and an additional low frequency enhancement (LFE) channel. Such 5.1 channel audio signals are used in DVD (Digital Versatile Disc) and SACD (Super Audio Compact Disc) systems. Because of the increasing popularity of multi-channel material, efficient coding of multi-channel material is becoming more important.

In the field of audio processing, it is well known to convert a number of audio channels into another number of audio channels. Such a conversion may be performed for various reasons. For example, an audio signal may be converted into another format to provide an enhanced user experience. E.g. traditional stereo recordings only comprise two channels whereas modern advanced audio systems typically use five or six channels, as in the popular 5.1 surround sound systems. Accordingly, the two stereo channels may be converted into five or six channels in order to take full advantage of the advanced audio system.

Another reason for a channel conversion is coding efficiency. It has been found that e.g. surround sound audio signals can be encoded as stereo channel audio signals combined with a parameter bit stream describing the multi-channel spatial properties of the audio signal. The decoder can reproduce the surround sound audio signals with a very satisfactory degree of accuracy. In this way, substantial bit rate savings may be obtained.

A 5.1-2-5.1 multi-channel audio coding system is known. In this known audio coding system a 5.1 input audio signal is encoded into and represented by two down-mix channels and associated parameters. The down-mix signals are also jointly referred to as spatial down-mix. In the known system, the spatial down-mix forms a stereo audio signal having a stereo image that is, as to quality, comparable to a fixed ITU down-mix from the 5.1 input channels. Users having only stereo equipment can listen to this spatial stereo down-mix, whilst listeners with 5.1 channel equipment can listen to the 5.1 channel reproduction that is made using this spatial stereo down-mix and the associated parameters. The 5.1 channel equipment decodes/reconstructs the 5.1 channel audio signal from the spatial stereo down-mix (i.e. the stereo audio signal) and the associated parameters.

However, a spatial stereo down-mix is often considered to be of reduced quality compared to an original stereo signal or an explicitly generated stereo signal. For example, professional studio engineers often tend to find the spatial stereo down-mix somewhat dull and uninteresting. For this reason, an artistic stereo down-mix, which differs from the spatial stereo down-mix is often generated. For instance extra reverberation or sources are added, the stereo image is widened, etc. In order for users to be able to enjoy the artistic stereo down-mix, this artistic down-mix, instead of the spatial down-mix, may be transmitted via a transmission medium or stored on a storage medium. However, as the parametric data for generating the 5.1 signal from the stereo signal is based on the original down-mix signal, this approach seriously affects the quality of the 5.1 channel audio signal reproduction. Specifically, the input 5.1 channel audio signal was encoded into a spatial stereo down-mix and associated parameters. By replacing the spatial stereo down-mix by the artistic stereo down-mix, the spatial stereo down-mix may no longer be available at the decoding end of the system and a high quality reconstruction of the 5.1 channel audio signal is not possible.

A possible approach to improve the quality of the 5.1 channel audio signal is to include further data of the spatial stereo down-mix signal. For example, in addition to the artistic stereo down-mix, the spatial stereo down-mix signal can be included in the same bitstream or can be transmitted in parallel. However, this substantially increases the data rate and thus the communication bandwidth or storage requirements and will degrade the quality to data rate ratio for an encoded multi-channel signal.

Hence, an improved encoding/decoding system for multi-channel audio would be advantageous and in particular a system allowing an improved performance, quality and/or quality to data rate ratio would be advantageous.

Accordingly, the Invention seeks to preferably mitigate, alleviate or eliminate one or more of the above mentioned disadvantages singly or in any combination.

According to a first aspect of the invention there is provided A multi-channel audio encoder for encoding an N-channel audio signal, the multi-channel audio encoder comprising: means for generating a first M-channel signal for the N-channel audio signal, M being smaller than N; means for generating first enhancement data for the first M-channel signal relative to the N-channel audio signal; means for generating a second M-channel signal for the N-channel audio signal; enhancement means for generating second enhancement data for the second M-channel signal relative to the first M-channel signal; means for generating an encoded output signal comprising the second M-channel signal, the first enhancement data and the second enhancement data; and wherein the enhancement means is arranged to dynamically select between generating the second enhancement data as absolute enhancement data or as relative enhancement data relative to the second M-channel signal.

The invention may allow an efficient encoding of a multi-channel signal. In particular, an efficient encoding with an increased quality to data rate ratio can be achieved. The invention may allow one M-channel signal to replace another M-channel signal with reduced impact on multi-channel generation based on enhancement data relating to the first M-channel signal. Specifically, an artistic down-mix may be transmitted instead of a spatial down-mix while allowing an efficient multi-channel recreation at a decoder based on enhancement data associated with the spatial down-mix. The dynamic selection of enhancement data allows a significantly reduced size of the enhancement data and/or an improved quality of the signal that can be generated.

The absolute enhancement data describes the first M-channel signal without referring to the second M-channel signal whereas the relative enhancement data describes the first M-channel signal with reference to the second M-channel signal.

The means for generating the first and/or second M-channel signal may generate the signals by processing the N-channel signal or e.g. by receiving the M-channel signal(s) from internal or external sources.

According to an optional feature of the invention, the enhancement means is arranged to select between the absolute enhancement data and the relative enhancement data in response to a characteristic of the N-channel signal.

This may allow an efficient performance and in particular may provide an encoded signal with improved quality to data rate ratio. The selection may for example be performed by evaluating one or more parameters derived from a characteristic of a segment of the N-channel signal and specifically based on one or more parameters derived from the first and/or second M-channel signal (which themselves can be derived from the N-channel signal).

According to an optional feature of the invention, the enhancement means is arranged to select between the absolute enhancement data and the relative enhancement data in response to a relative characteristic of the absolute enhancement data and the relative enhancement data.

This may allow an efficient performance and in particular may provide an encoded signal with improved quality to data rate ratio. Alternatively or additionally, it may allow an efficient and/or low complexity implementation.

According to an optional feature of the invention, the relative characteristic is a signal energy of the absolute enhancement data relative to a signal energy of the relative enhancement data.

This may allow an efficient performance and in particular may provide an encoded signal with improved quality to data rate ratio. Alternatively or additionally, it may allow an efficient and/or low complexity implementation. Specifically, the enhancement means may select the type of enhancement data which has the lowest signal energy.

According to an optional feature of the invention, the enhancement means is arranged to divide the second M-channel signal into signal blocks and to individually select between the absolute enhancement data and the relative enhancement data for each signal block.

This may allow an efficient performance and in particular may provide an encoded signal with improved quality to data rate ratio. Alternatively or additionally, it may allow an efficient and/or low complexity implementation. The signal blocks may be divided in the time and/or frequency domain and each signal block may specifically comprise a group of time/frequency tiles. The division into signal blocks may be applied to the first M-channel signal and/or the N-channel signal.

According to an optional feature of the invention, the enhancement means is arranged to select between the absolute enhancement data and the relative enhancement data for a signal block based only on characteristics associated with the signal block.

This may allow an efficient performance and in particular may provide an encoded signal with improved quality to data rate ratio. Alternatively or additionally, it may allow an efficient and/or low complexity implementation. Specifically, the enhancement means may select the type of enhancement data which has the lowest signal energy.

According to an optional feature of the invention, the enhancement means is arranged to generate the enhancement data as a combination of the absolute enhancement data and the relative enhancement data during a switch time interval of a switch between generating the enhancement data as absolute enhancement data and as relative enhancement data.

This may allow improved switching and may in particular reduce artifacts associated with the switching. An improved sound quality may be achieved. The combination during a switch time interval may be applied when switching from absolute to relative enhancement data and/or from relative to absolute enhancement data. The combination may be achieved using an overlap and add technique.

According to an optional feature of the invention, the combination comprises an interpolation between the absolute enhancement data and the relative enhancement data.

This may allow a practical and efficient implementation with high quality. An improved sound quality may be achieved.

According to an optional feature of the invention, the means for generating the encoded output signal is arranged to include data indicating if relative enhancement data or absolute enhancement data is used.

This may allow an efficient performance and in particular may provide an encoded signal with improved quality to data rate ratio. Alternatively or additionally, it may allow an efficient and/or low complexity implementation. The indication data may specifically include a selection indication for each signal block.

According to an optional feature of the invention, the second enhancement data comprises a first part of enhancement data and a second part of enhancement data, the second part providing a higher quality representation of the first M-channel signal than the first part.

This may allow an efficient performance and in particular may provide an encoded signal with improved quality to data rate ratio. The first part may have a lower data rate than the second part. The second part may comprise data that more accurately allows a decoder to recreate the first M-channel signal.

According to an optional feature of the invention, the enhancement means is arranged to dynamically select only between generating the second part as absolute enhancement data or as relative enhancement data relative.

This may allow an efficient performance and in particular may provide an encoded signal with improved quality to data rate ratio.

According to an optional feature of the invention, the enhancement means is arranged to generate relative data of the second part relative to a reference signal generated by applying enhancement data of the first part to the first M-channel signal.

This may allow an efficient performance and in particular may provide an encoded signal with improved quality to data rate ratio.

According to another aspect of the invention, there is provided a multi-channel audio decoder for decoding an N-channel audio signal, the multi-channel audio decoder comprising: means for receiving an encoded audio signal comprising a first M-channel signal for the N-channel audio signal, M being smaller than N, first enhancement data for multi-channel expansion, the first enhancement data being relative to a second M-channel signal different than the first M-channel signal; second enhancement data for the first M-channel signal relative to the second M-channel signal, the second enhancement data comprising absolute enhancement data and relative enhancement data relative to the first M-channel signal, and indication data indicative of whether the second enhancement data for a signal block is absolute enhancement data or relative enhancement data; generating means for generating an M-channel multi-channel expansion signal in response to the first M-channel signal and the second enhancement data; and means for generating an N-channel decoded signal in response to the M-channel multi-channel expansion signal and the first enhancement data; and wherein the generating means is arranged to select between applying the second enhancement data as absolute enhancement data or relative enhancement data in response to the indication data.

The invention may allow an efficient and high performance decoding of a multi-channel signal. In particular, an efficient decoding of a signal with improved quality for a given data rate can be achieved. The invention may allow one M-channel signal to replace another M-channel signal with reduced impact on multi-channel generation based on enhancement data relating to the first M-channel signal. Specifically, an artistic down-mix may be transmitted instead of a spatial down-mix while allowing an efficient multi-channel recreation at the decoder based on enhancement data associated with the spatial down-mix.

The absolute enhancement data describes the second M-channel signal without referring to the first M-channel signal whereas the relative enhancement data describes the second M-channel signal with reference to the first M-channel signal.

According to an optional feature of the invention, the generating means is arranged to apply the second enhancement data to the first M-channel signal in the time domain.

This may allow an efficient performance and in particular may provide a decoded signal with improved quality for a given data rate. Alternatively or additionally, it may allow an efficient and/or low complexity implementation.

According to an optional feature of the invention, the generating means is arranged to apply the second enhancement data to the first M-channel signal in the frequency domain.

This may allow an efficient performance and in particular may provide a decoded signal with improved quality for a given data rate. Alternatively or additionally, it may allow an efficient and/or low complexity implementation.

In particular, in many embodiments, the frequency domain application may reduce the required number of time to frequency transforms. The frequency domain may for example be a Quadrature Mirror Filterbank (QMF) or Modified Discrete Cosine Transform (MDCT) domain.

According to an optional feature of the invention, the second enhancement data comprises a first part of enhancement data and a second part of enhancement data, the second part providing a higher quality representation of the first M-channel signal than the first part.

This may allow an efficient performance and in particular may provide a decoded signal with improved quality for a given data rate. Alternatively or additionally, it may allow an efficient and/or low complexity implementation. The second part may comprise data that more accurately allows a decoder to recreate the first M-channel signal.

According to an optional feature of the invention, the generating means is arranged to only select between applying second enhancement data of the second part as absolute enhancement data or relative enhancement data.

This may allow an efficient performance and in particular may provide a decoded signal with improved quality for a given data rate. Alternatively or additionally, it may allow an efficient and/or low complexity implementation.

According to an optional feature of the invention, the generating means is arranged to generate the M-channel multi-channel expansion by applying relative enhancement data of the second part to a signal generated by applying enhancement data of the first part to the first M-channel signal.

This may allow an efficient performance and in particular may provide a decoded signal with improved quality for a given data rate. Alternatively or additionally, it may allow an efficient and/or low complexity implementation.

According to another aspect of the invention, there is provided a method of encoding an N-channel audio signal, the method comprising: generating a first M-channel signal for the N-channel audio signal, M being smaller than N; generating first enhancement data for the first M-channel signal relative to the N-channel audio signal; generating a second M-channel signal for the N-channel audio signal; generating second enhancement data for the second M-channel signal relative to the first M-channel signal; generating an encoded output signal comprising the second M-channel signal, the first enhancement data and the second enhancement data; and wherein the generation of the second enhancement data comprises dynamically selecting between generating the second enhancement data as absolute enhancement data or as relative enhancement data relative to the second M-channel signal.

According to another aspect of the invention, there is provided a method of decoding an N-channel audio signal, the method comprising: receiving an encoded audio signal comprising a first M-channel signal for the N-channel audio signal, M being smaller than N, first enhancement data for multi-channel expansion, the first enhancement data being relative to a second M-channel signal different than the first M-channel signal; second enhancement data for the first M-channel signal relative to the second M-channel signal, the second enhancement data comprising absolute enhancement data and relative enhancement data relative to the first M-channel signal, and indication data indicative of whether the second enhancement data for a signal block is absolute enhancement data or relative enhancement data; generating an M-channel multi-channel expansion signal in response to the first M-channel signal and the second enhancement data; and generating an N-channel decoded signal in response to the M-channel multi-channel expansion signal and the first enhancement data; and wherein the generation of the M-channel multi-channel expansion signal comprises selecting between applying the second enhancement data as absolute enhancement data or relative enhancement data in response to the indication data.

According to another aspect of the invention, there is provided an encoded multi-channel audio signal for an N-channel audio signal comprising: M-channel signal data for the N-channel audio signal, M being smaller than N; first enhancement data for multi-channel expansion, the first enhancement data being relative to a second M-channel signal different than the first M-channel signal; second enhancement data for the first M-channel signal relative to the second M-channel signal, the second enhancement data comprising absolute enhancement data and relative enhancement data relative to the first M-channel signal; and indication data indicative of whether the second enhancement data for a signal block is absolute enhancement data or relative enhancement data.

According to another aspect of the invention, there is provided a storage medium having stored thereon a signal as described above.

According to another aspect of the invention, there is provided a transmitter for transmitting an encoded multi-channel audio signal, the transmitter comprising a multi-channel audio encoder as described above.

According to another aspect of the invention, there is provided a receiver for receiving a multi-channel audio signal, the receiver comprising a multi-channel audio decoder as described above.

According to another aspect of the invention, there is provided a transmission system comprising a transmitter for transmitting an encoded multi-channel audio signal via a transmission channel to a receiver, the transmitter comprising a multi-channel audio encoder as described above and the receiver comprising a multi-channel audio decoder as described above.

According to another aspect of the invention, there is provided a method of transmitting an encoded multi-channel audio signal, the method comprising encoding an N-channel audio signal, wherein the encoding comprises: generating a first M-channel signal for the N-channel audio signal, M being smaller than N; generating first enhancement data for the first M-channel signal relative to the N-channel audio signal; generating a second M-channel signal for the N-channel audio signal; generating second enhancement data for the second M-channel signal relative to the first M-channel signal; generating an encoded output signal comprising the second M-channel signal, the first enhancement data and the second enhancement data; and wherein the generation of the second enhancement data comprises dynamically selecting between generating the second enhancement data as absolute enhancement data or as relative enhancement data relative to the second M-channel signal.

According to another aspect of the invention, there is provided a method of receiving an encoded multi-channel audio signal, the method comprising decoding the encoded multi-channel audio signal, the decoding comprising receiving the encoded multi-channel audio signal comprising a first M-channel signal for the N-channel audio signal, M being smaller than N, first enhancement data for multi-channel expansion, the first enhancement data being relative to a second M-channel signal different than the first M-channel signal; second enhancement data for the first M-channel signal relative to the second M-channel signal, the second enhancement data comprising absolute enhancement data and relative enhancement data relative to the first M-channel signal, and indication data indicative of whether the second enhancement data for a signal block is absolute enhancement data or relative enhancement data; generating an M-channel multi-channel expansion signal in response to the first M-channel signal and the second enhancement data; and generating an N-channel decoded signal in response to the M-channel multi-channel expansion signal and the first enhancement data; and wherein the generation of the M-channel multi-channel expansion signal comprises selecting between applying the second enhancement data as absolute enhancement data or relative enhancement data in response to the indication data.

According to another aspect of the invention, there is provided a method of transmitting and receiving an audio signal, the method comprising: encoding an N-channel audio signal, wherein the encoding comprises: generating a first M-channel signal for the N-channel audio signal, M being smaller than N, generating first enhancement data for the first M-channel signal relative to the N-channel audio signal, generating a second M-channel signal for the N-channel audio signal, generating second enhancement data for the second M-channel signal relative to the first M-channel signal, the generation of the second enhancement data comprising dynamically selecting between generating the second enhancement data as absolute enhancement data or as relative enhancement data relative to the second M-channel signal generating an encoded output signal comprising the second M-channel signal, the first enhancement data and the second enhancement data; transmitting the encoded output signal from a transmitter to a receiver; receiving, at the receiver, the encoded output signal; decoding the encoded output signal wherein the decoding comprises: generating an M-channel multi-channel expansion signal in response to the second M-channel signal and the second enhancement data, the generation of the M-channel multi-channel expansion signal comprising selecting between applying the second enhancement data as absolute enhancement data or relative enhancement data, and generating an N-channel decoded signal in response to the M-channel multi-channel expansion signal and the first enhancement data.

According to another aspect of the invention, there is provided a computer program product operative to cause a processor to perform the steps of the method described above.

According to another aspect of the invention, there is provided a multi-channel audio recorder comprising a multi-channel audio encoder as described above.

According to another aspect of the invention, there is provided a multi-channel audio player (60) comprising a multi-channel audio decoder as described above.

These and other aspects, features and advantages of the invention will be apparent from and elucidated with reference to the embodiment(s) described hereinafter.

Embodiments of the invention will be described, by way of example only, with reference to the drawings, in which.

The following description focuses on embodiments of the invention applicable to a 5.1-to-2 encoder and/or a 2-to-5.1 decoder. However, it will be appreciated that the invention is not limited to this application.

Figure 1:
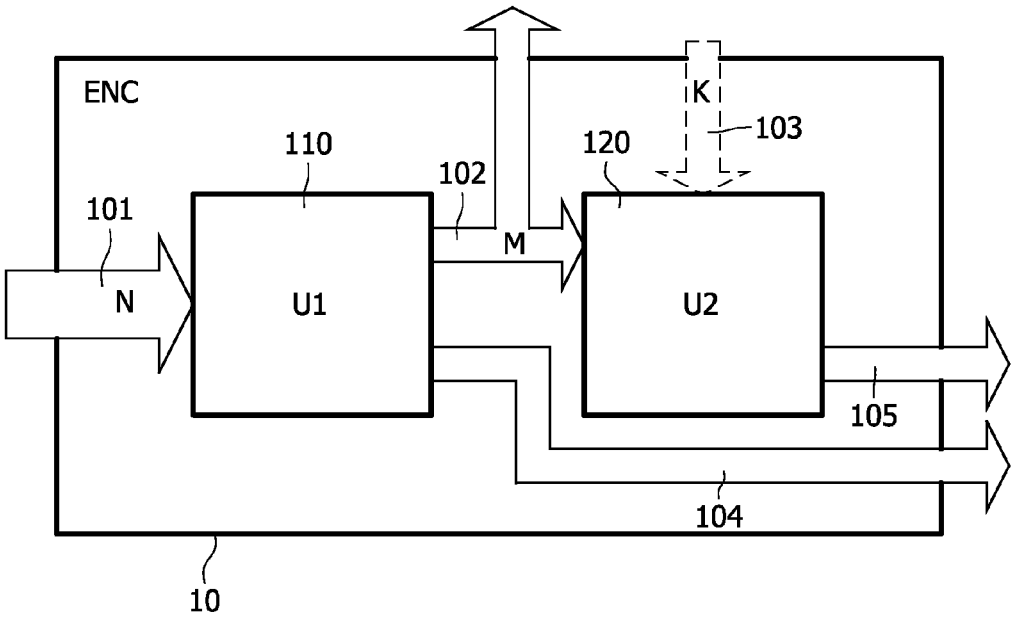
FIG. 1 shows a block diagram of a multi-channel audio encoder according to some embodiments of the invention.

FIG. 1 shows a block diagram of an embodiment of a multi-channel audio encoder 10 according to some embodiments of the invention. This multi-channel audio encoder 10 is arranged for encoding N audio signals 101 into M audio signals 102 and associated parametric data 104, 105. In this, M and N are integers, with N>M and M≧1. An example of the multi-channel audio encoder 10 is a 5.1-to-2 encoder in which N is equal to 6, i.e. 5+1 channels, and M is equal to 2. Such a multi-channel audio encoder encodes a 5.1 channel input audio signal into a 2 channel output audio signal, e.g. a stereo output audio signal, and associated parameters. Other examples of the multi-channel audio encoder 10 are 5.1-to-1, 6.1-to-2, 6.1-to-1, 7.1-to-2 and 7.1-to-1 encoders. Also encoders having other values for N and M are possible as long as N is larger than M and as long as M is larger than or equal to 1.

The encoder 10 comprises a first encoding unit 110 and coupled thereto a second encoding unit 120. The first encoding unit 110 receives the N input audio signals 101 and encodes the N audio signals 101 into the M audio signals 102 and first associated parametric data 104. The M audio signals 102 and the first associated parametric data 104 represent the N audio signals 101. The encoding of the N audio signals 101 into the M audio signals 102 as performed by the first unit 110 may also be referred to as down-mixing and the M audio signals 102 may also be referred to as spatial down-mix 102.

The unit 110 may be a conventional parametric multi-channel audio encoder that encodes a multi-channel audio signal 101 into a mono or stereo down-mix audio signal 102 and associated parameters 104. The associated parameters 104 enable a decoder to reconstruct the multi-channel audio signal 101 from the mono or stereo down-mix audio signal 102. It is noted that the down-mix 102 may also have more than two channels.

The first unit 110 supplies the spatial down-mix 102 to the second unit 120. The second unit 120 generates, from the spatial down-mix 102, second enhancement data in the form of second associated parametric data 105. The second associated parametric data 105 represents the spatial down-mix 102, i.e. these parameters 105 comprise characteristics or properties of the spatial down-mix 102 which enable a decoder to reconstruct at least part of the spatial down-mix 102, e.g. by synthesizing a signal resembling the spatial down-mix 102. The associated parametric data comprise the first and second associated parametric data 104 and 105.

The second associated parametric data 105 comprises modification parameters enabling a reconstruction of the spatial down-mix 102 from K (=M) further audio signals 103. In this way, a decoder may perform an even better reconstruction of the spatial down-mix 102. This reconstruction may be done on basis of an alternative down-mix 103, i.e. the K further audio signals 103, such as an artistic down-mix. A decoder may apply the modification parameters to the alternative down-mix signal 103 so that it more closely resembles the spatial down-mix 102.

The second unit 120 may receive at its inputs the alternative down-mix 103. The alternative down-mix 103 may be received from a source external to the encoder 10 (as shown in FIG. 1) or, alternatively, the alternative down-mix 103 may be generated inside the encoder 10 (not shown), e.g. from the N audio signals 101. The second unit 120 may compare at least some of the spatial down-mix 102 with the alternative down-mix 103 and generate modification parameters 105 representing a difference between the spatial down-mix 102 and the alternative down-mix 103, e.g. a difference between a property of the spatial down-mix 102 and a property of the alternative down-mix 103. In the example, the alternative down-mix 103 is specifically an artistic down-mix associated with the spatial down-mix.

In the example, the second unit 120 may furthermore generate the modification parameters as absolute values which directly represent the spatial down-mix 102 without any reference to the alternative down-mix 103. Furthermore, the second unit 120 comprises functionality for selecting between the relative and the absolute modification parameters for the encoder output signal. Specifically, this selection is dynamically performed and can be done for individual signal blocks depending on the characteristics of the signal and/or the parametric data.

In addition, the second unit 120 can comprise functionality for including an indication of which modification parameters (absolute or relative) have been used for different sections of the encoded signal. For example, for each signal block, a data bit can be included to indicate if relative or absolute parametric data has been included for that signal block.

The modification parameters 105 preferably comprise (a difference between) one or more statistical signal properties such as variance, covariance and correlation, or a ratio of these properties, or of the (difference between the) down-mix signal(s). It is noted that the variance of a signal is equivalent to the energy or power of that signal. These statistical signal properties enable a good reconstruction of the spatial down-mix.

Figure 2:
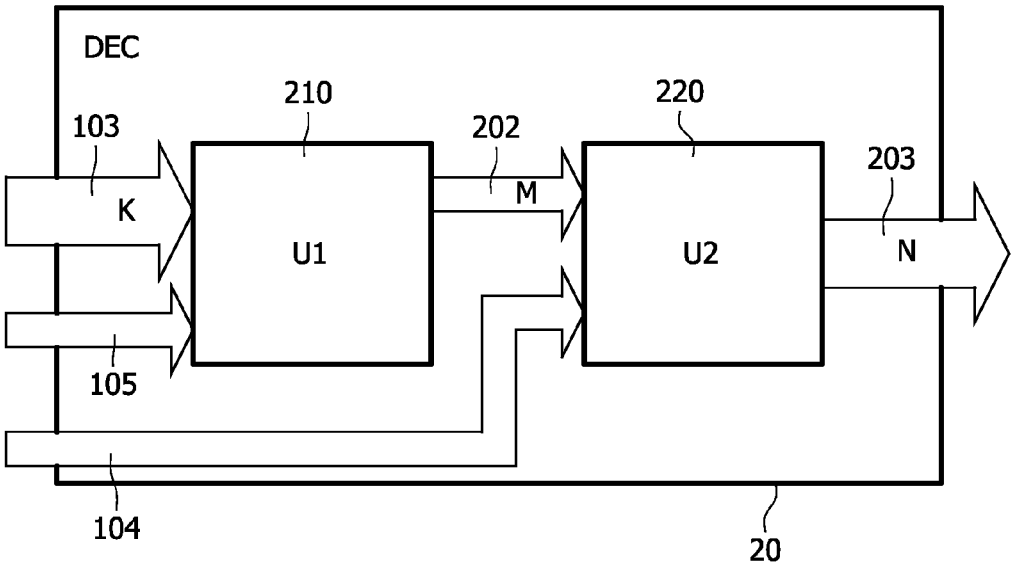
FIG. 2 shows a block diagram of a multi-channel audio decoder according to some embodiments of the invention.

FIG. 2 shows a block diagram of an embodiment of a multi-channel audio decoder 20 according to some embodiments of the invention. The decoder 20 is arranged for decoding K audio signals 103 and associated parametric data 104, 105 into N audio signals 203. In this, K and N are integers, with N>K and K≧1. The K audio signals 103, i.e. the alternative down-mix 103, and the associated parametric data 104, 105 represent the N audio signals 203, i.e. the multi-channel audio signal 203. An example of the multi-channel audio decoder 20 is a 2-to-5.1 decoder in which N is equal to 6, i.e. 5+1 channels, and K is equal to 2. Such a multi-channel audio decoder decodes a 2 channel input audio signal, e.g. a stereo input audio signal, and associated parameters into a 5.1 channel output audio signal. Other examples of the multi-channel audio decoder 20 are 1-to-5.1, 2-to-6.1, 1-to-6.1, 2-to-7.1 and 1-to-7.1 decoders. Also decoders having other values for N and K are possible as long as N is larger than K and as long as K is larger than or equal to 1.

The multi-channel audio decoder 20 comprises a first unit 210 and coupled thereto a second unit 220. The first unit 210 receives the alternative down-mix 103 and enhancement data in the form of modification parameters 105 and reconstructs M further audio signals 202, i.e. the spatial down-mix 202 or an approximation thereof, from the alternative down-mix 103 and the modification parameters 105. In this, M is an integer, with M≧1. The modification parameters 105 represent the spatial down-mix 202. The first unit 210 is specifically arranged to determine if modification parameters 105 are absolute or relative modification parameters and to apply the parameters accordingly. Specifically, the first unit 210 can determine if the modification parameters 105 for individual signal blocks are relative or absolute parameters based on explicit data in the received bitstream. For example, a single data bit can be included for each signal block indicating if the parameters are absolute or relative modification parameters in that signal block.

The second unit 220 receives the spatial down-mix 202 from the first unit 210 and modification parameters 104. The second unit 220 decodes the spatial down-mix 202 and modification parameters 104 into the multi-channel audio signal 203. The second unit 220 may be a conventional parametric multi-channel audio decoder that decodes a mono or stereo down-mix audio signal 202 and associated parameters 104 into a multi-channel audio signal 203.

The first unit 210 may be arranged for determining whether it is necessary or desirable to reconstruct the signal 202 from the input signal 103. Such reconstruction may not be applicable when the spatial down-mix signal 202 is supplied to the first unit 210 instead of the alternative down-mix 103. The first unit 210 can determine this by generating from the input signal 103 similar or same signal properties as are comprised in the modification parameters 105 and by comparing these generated signal properties with the modification parameters 105. If this comparison shows that the generated signal properties are equal to or substantially equal to the modification parameters 105 then the input signal 103 sufficiently resembles the spatial down-mix signal 202 and the first unit 210 can forward the input signal 103 to the second unit 220. If the comparison shows that the generated signal properties are not equal to or substantially equal to the modification parameters 105 then the input signal 103 does not sufficiently resemble the spatial down-mix signal 202 and the first unit 210 can reconstruct/approximate the spatial down-mix signal 202 from the input signal 103 and the modification parameters 105.

The first unit 210 may generate, from the alternative down-mix, further modification parameters/properties representing the alternative down-mix 103. In such a case, the first unit 210 may reconstruct the spatial down-mix 202 from the alternative down-mix 103 and (a difference between) the modification parameters 105 and the further modification parameters.

The modification parameters 105 and the further modification parameters, respectively, may include statistical properties of the spatial down-mix 202 and the alternative down-mix 103, respectively. These statistical properties such as variance, correlation and covariance, etc. provide good representations of the signals they are derived from. They are useful in reconstructing the spatial down-mix 202, e.g. by transforming the alternative down-mix such that its associated properties match the properties comprised in the modification parameters 105.

Figure 3:
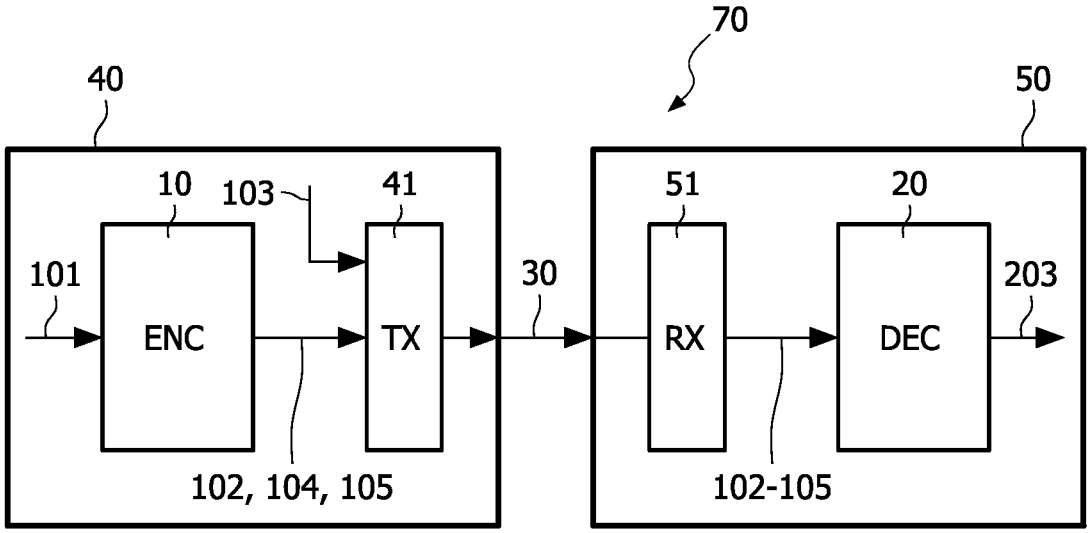
FIG. 3 shows a block diagram of a transmission system according to some embodiments of the invention.

FIG. 3 shows a block diagram of an embodiment of a transmission system 70 according to some embodiments of the invention. The transmission system 70 comprises a transmitter 40 for transmitting an encoded multi-channel audio signal via a transmission channel 30, e.g. a wired or wireless communication link, to a receiver 50. The transmitter 40 comprises a multi-channel audio encoder 10 as described above for encoding the multi-channel audio signal 101 into a spatial down-mix 102 and associated parameters 104, 105. The transmitter 40 further comprises means 41 for transmitting an encoded multi-channel audio signal comprising the parameters 104, 105 and the spatial down-mix 102 or the alternative down-mix 103 via the transmission channel 30 to the receiver 50. The receiver 50 comprises means 51 for receiving the encoded multi-channel audio signal and a multi-channel audio decoder 20 as described above for decoding the alternative down-mix 103 or the spatial down-mix 102 and the associated parameters 104, 105 into the multi-channel audio signal 203.

Figure 4:
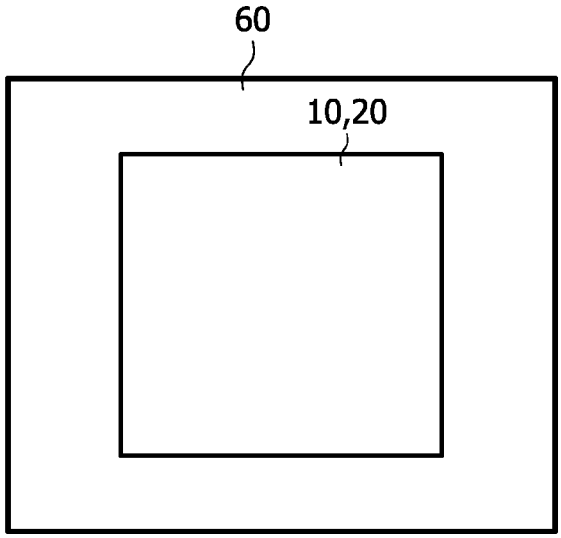
FIG. 4 shows a block diagram of a multi-channel audio player/recorder according to some embodiments of the invention.

FIG. 4 shows a block diagram of an embodiment of a multi-channel audio player/recorder 60 according to some embodiments of the invention. The audio player/recorder 60 comprises a multi-channel audio decoder 20 and/or a multi-channel audio encoder 10 according to some embodiments of the invention. The audio player/recorder 60 can have its own storage for example solid-state memory or hard disk. The audio player/recorder 60 may also facilitate detachable storage means such as (recordable) DVD discs or (recordable) CD discs. Stored encoded multi-channel audio signals comprising an alternative down-mix 103 and parameters 104, 105 can be decoded by the decoder 20 and be played or reproduced by the audio player/recorder 60. The encoder 10 may encode multi-channel audio signals for storage on the storage means.

Figure 5:
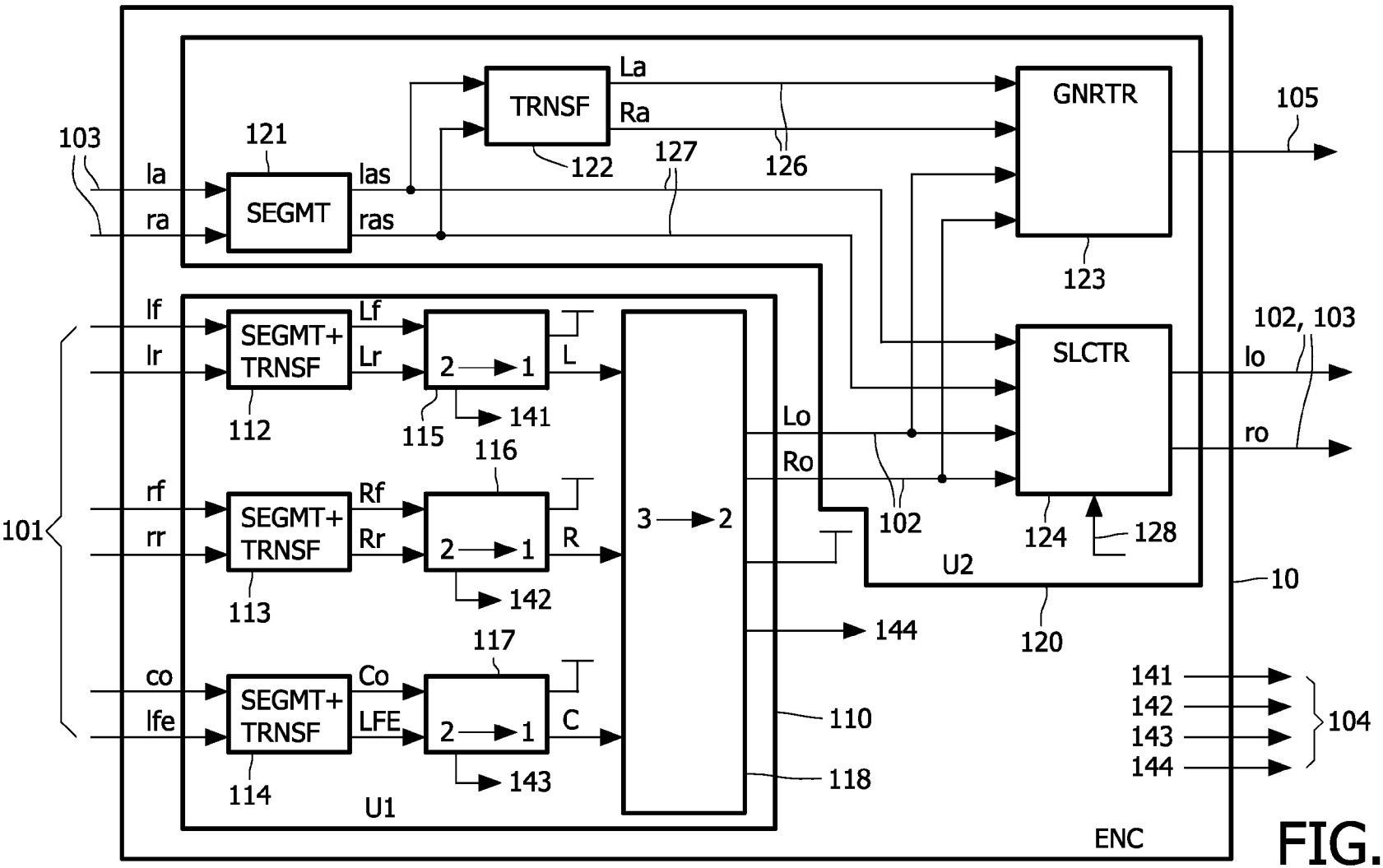
FIG. 5 shows a block diagram of a multi-channel audio encoder according to some embodiments of the invention.

FIG. 5 shows a block diagram of a multi-channel audio encoder 10 according to some embodiments the invention. The encoder of FIG. 5 may specifically be the encoder 10 of FIG. 1. The encoder 10 comprises a first unit 110 and coupled thereto a second unit 120. The first unit 110 receives a 5.1 multi-channel audio signal 101 comprising left front, left rear, right front, right rear, center and low frequency enhancement audio signals lf, lr, rf, rr, co and lfe, respectively. The second unit 120 receives an artistic stereo down-mix 103 comprising left artistic and right artistic audio signals la and ra, respectively. The multi-channel audio signal 101 and the artistic down-mix 103 are time-domain audio signals. In the first and second units 110 and 120 these signals 101 and 103 are segmented and transformed to the frequency-time domain.

In the first unit 110, parametric data 104 is derived in three stages. In a first stage, three pairs of audio signals lf and lr, rf and rr, and co and lfe, respectively, are segmented and the segmented signals are transformed to the frequency domain in segmentation and transformation units 112, 113, and 114, respectively. The resulting frequency domain representations of the segmented signals are shown as frequency domain signals Lf, Lr, Rf, Rr, Co and LFE, respectively. In a second stage, three pairs of these frequency domain signals Lf and Lr, Rf and Rr, and Co and LFE, respectively, are downmixed in down-mixers 115, 116, and 117, respectively, to generate mono audio signals L, R, and C, respectively and associated parameters 141, 142, and 143, respectively. The downmixers 115, 116, and 117 may be conventional MPEG4 parametric stereo encoders. Finally, in a third stage, the three mono audio signals L, R and C are down-mixed in a down-mixer 118 to obtain a spatial stereo down-mix 102 and associated parameters 144. The spatial down-mix 102 comprises signals Lo and Ro.

The parametric data 141, 142, 143, and 144 are comprised in the first enhancement data in the form of first associated parametric data 104. The parametric data 104 and the spatial down-mix 102 represent the 5.1 input signals 101.

In the second unit, the artistic down-mix signal 103 represented in time domain by audio signals la and ra, respectively, is first segmented in segmentation unit 121. The resulting segmented audio signal 127 comprises signals las and ras, respectively. Next, this segmented audio signal 127 is transformed to the frequency domain by transformer 122. The resulting frequency domain signal 126 comprises signals La and Ra. Finally, the frequency domain signal 126, which is a frequency domain representation of the segmented artistic down-mix 103, and the frequency domain representation of the segmented spatial down-mix 102 are supplied to a generator 123 which generates further (second) enhancement data in the form of modification parameters 105 which enable a decoder to modify/transform the artistic down-mix 103 so that it more closely resembles the spatial down-mix 102.

In the specific example, the segmented time-domain signal 127 is also fed to a selector 124. The other two inputs to this selector 124 are the frequency domain representation of the spatial stereo down-mix 102 and a control signal 128. The control signal 128 determines whether the selector 124 is to output the artistic down-mix 103 or the spatial down-mix 102 as part of the encoded multi-channel audio signal. The spatial down-mix 102 may be selected when the artistic down-mix is not available. The control signal 128 can be manually set or can be automatically generated by sensing the presence of the artistic down-mix 103. The control signal 128 may be included in the parameter bit-stream so that a corresponding decoder 20 can make use of it as described later. Thus, the specific exemplary encoder allows a signal to be generated which includes the spatial down-mix 102 or the artistic down-mix 103.

The output signal 102, 103 of the selector 124 is shown as signals lo and ro. If the artistic stereo down-mix 127 is to be output by the selector 124 the segmented time domain signals las and ras are combined in the selector 124 by overlap-add into signals lo and ro. If the spatial stereo down-mix 102 is to be output as indicated by the control signal 128, the selector 124 transforms the signals Lo and Ro back to the time domain and combines them via overlap-add into the signals lo and ro. The time-domain signals lo and ro form the stereo down-mix of the 5.1-to-2 encoder 10.

A more detailed description of the generator 123 is provided in the following. The function of the generator 123 is to determine second enhancement data and specifically modification parameters that describe a transformation of the artistic down-mix 103 so that it, in some sense, resembles the original spatial down-mix 102.

In general, this transformation can be described as $$[\underline{L}_d\ \underline{R}_d]=[\underline{L}_a\ \underline{R}_a\ \underline{A}_1 \ldots \underline{A}_N]T \quad (1)$$

wherein $\underline{L}_a$ and $\underline{R}_a$ are vectors comprising samples of a time/frequency tile of the left and right channel of the artistic down-mix 103, and wherein $\underline{L}_d$ and $\underline{R}_d$ are vectors comprising samples of a time/frequency tile of the left and right channel of the modified artistic down-mix, wherein $\underline{A}_1, \ldots, \underline{A}_N$ comprise the samples of a time/frequency tile of optional auxiliary channels, and wherein T is a transformation matrix. Note that any vector $\underline{V}$ is defined as a column vector. The modified artistic down-mix is the artistic down-mix 103 that is transformed by the transform so that it resembles the original spatial down-mix 102. The auxiliary channels $\underline{A}_1, \ldots, \underline{A}_N$ are in the described system the spatial down-mix signals or low-frequency content thereof.

The (N+2)×2-transformation matrix T describes the transformation from the artistic down-mix 103 and the auxiliary channels to the modified artistic down-mix. The transformation matrix T or elements thereof are preferably comprised in the modification parameters 105 so that a decoder 20 can reconstruct at least part of the transformation matrix 7'. Thereafter, the decoder 20 can apply the transformation matrix T to the artistic down-mix 103 to reconstruct the spatial down-mix 102 (as described below).

Alternatively, the modification parameters 105 comprise signal properties, e.g. energy or power values and/or correlation values, of the spatial down-mix 102. The decoder 20 can then generate such signal properties from the artistic down-mix 103. The signal properties of the spatial down-mix 102 and the artistic down-mix 103 enable the decoder 20 to construct a transformation matrix T (described below) and to apply it to the artistic down-mix 103 to reconstruct the spatial down-mix 102 (also described below).

Specifically, the generator 123 is arranged to generate both relative and absolute modification data and to select between this data for individual signal blocks (or segments). Thus, the modification parameters 105 for the encoded signal comprises both absolute modification data and relative modification data for different signal blocks. In contrast to the absolute modification data, the relative modification data describes the spatial down-mix 102 relative to the artistic down-mix 103. Specifically, the relative modification data may be differential data which allows artistic down-mix samples to be modified to correspond (more closely) to the spatial down-mix samples whereas the absolute down-mix data may directly correspond to the spatial down-mix samples without any reference or reliance on the artistic down-mix samples.

It will be appreciated that there are several ways of modifying the artistic stereo down-mix 103 to resemble the original stereo down-mix 102, including:

I. Match of waveforms.

II. Match of statistical properties:

a. Match of the energy or power of the left and the right channel.

b. Match of the covariance matrix of the left and right channel.

III. Obtain the best possible match of the waveform under the constraint of an energy or power match of the left and the right channel.

IV. Mixing the above-mentioned methods I-III.

For clarity, the auxiliary channels $\underline{A}_1, \ldots, \underline{A}_N$ of (1) are first not considered, so that the transformation matrix T can be written as $$[\underline{L}_d\ \underline{R}_d]=[\underline{L}_a\ \underline{R}_a]T \quad (2)$$

and relative enhancement data may for example be generated as the following:

I. Waveform Match (Method I)

A match of the waveforms of the artistic down-mix 103 and the spatial down-mix 102 can be obtained by expressing both the left and the right signal of the modified artistic down-mix as a linear combination of the left and the right signal of the artistic stereo down-mix 103:

$$\underline{L}_d=\alpha_1\underline{L}_a+\beta_1\underline{R}_a,\ \underline{R}_d=\alpha_2\underline{L}_a+\beta_2\underline{R}_a. \quad (3)$$

Then, matrix T of (2) can be written as:

$$T=\begin{bmatrix}\alpha_1 & \alpha_2\\ \beta_1 & \beta_2\end{bmatrix}.$$

A way to choose the parameters $\alpha_1$, $\alpha_2$, $\beta_1$ and $\beta_2$, is to minimize the square of the Euclidian distance between the spatial down-mix signals $L_s$ and $R_s$ and their estimations (i.e. the modified artistic down-mix signals $L_d$ and $R_d$), hence $$\min_{\alpha_1,\beta_1}\sum_k \|L_s[k]-L_d[k]\|^2=\min_{\alpha_1,\beta_1}\sum_k\left\|\begin{matrix}L_s[k]-\alpha_1L_a[k]-\\ \beta_1R_a[k]\end{matrix}\right\|^2 \quad (4)$$

and $$\min_{\alpha_2,\beta_2}\sum_k \|R_s[k]-R_d[k]\|^2=\min_{\alpha_2,\beta_2}\sum_k\left\|\begin{matrix}R_s[k]-\alpha_2L_a[k]-\\ \beta_2R_a[k]\end{matrix}\right\|^2. \quad (5)$$

II. Match of Statistical Properties (Method II)

Method II.a: matching the energies of the left and the right signals is now discussed. The modified left and right artistic down-mix signal, denoted by $L_d$ and $R_d$ respectively, are now computed as $$\underline{L}_d=\alpha\underline{L}_a,\ \underline{R}_d=\beta\underline{R}_a, \quad (6)$$

where, in the case of real parameters, α and β are given by $$\alpha=\sqrt{\frac{\sum_k\|L_s[k]\|^2}{\sum_k\|L_a[k]\|^2}},\quad \beta=\sqrt{\frac{\sum_k\|R_s[k]\|^2}{\sum_k\|R_a[k]\|^2}}, \quad (7)$$

so that the transformation matrix T can be written as $$T=\begin{bmatrix}\sqrt{\frac{\sum_k\|L_s[k]\|^2}{\sum_k\|L_a[k]\|^2}} & 0\\ 0 & \sqrt{\frac{\sum_k\|R_s[k]\|^2}{\sum_k\|R_a[k]\|^2}}\end{bmatrix}. \quad (8)$$

With these choices it can be ensured that the signals $L_d$ and $R_d$, respectively, have the same energy as the signals $L_s$ and $R_s$, respectively.

Method II.b: For matching the covariance matrices of the artistic stereo down-mix 103 and the spatial stereo down-mix 102 these matrices can be decomposed using eigenvalue decomposition as follows:

$$C_a=U_aS_aU_a^H,$$

$$C_0=U_0S_0U_0^H, \tag{9}$$

where the covariance matrix of the artistic stereo down-mix 103, $C_a$, is given by $$C_a=[\underline{L}_a\ \underline{R}_a]^H[\underline{L}_a\ \underline{R}_a]. \tag{10}$$

$U_a$ is a unitary matrix and $S_a$ is a diagonal matrix. $C_0$ is the covariance matrix of the spatial stereo down-mix 102, $U_o$ is a unitary matrix and $S_o$ is a diagonal matrix. When computing $$X_{aw}=[\underline{L}_{aw}\ \underline{R}_{aw}]=[\underline{L}_a\ \underline{R}_a]U_aS_a^{-1/2}, \tag{11}$$

two mutually uncorrelated signals $\underline{L}_{aw}$ and $\underline{R}_{aw}$ are obtained (due to the multiplication with matrix $U_a$), which signals have unit energy (due to the multiplication with matrix $S_a^{-1/2}$). By computing:

$$X_d=[\underline{L}_d\ \underline{R}_d]=[\underline{L}_a\ \underline{R}_a]U_aS_a^{-1/2}U_rS_0^{1/2}U_0^H, \tag{12}$$

first the covariance matrix of $[\underline{L}_a\ \underline{R}_a]$ is transformed into a covariance matrix that equals the identity matrix, i.e. the covariance matrix of $[\underline{L}_a\ \underline{R}_a]U_aS_a^{-1/2}$. Applying any arbitrary unitary matrix $U_r$ will not change the covariance structure, and applying $S_0^{1/2}U_0^H$ results in a covariance structure equal to that of the spatial stereo down-mix 102.

Define the matrix $S_{0w}$ and the signals $\underline{L}_{0w}$ and $\underline{R}_{0w}$ as follows:

$$S_{0w}=[\underline{L}_{0w}\ \underline{R}_{0w}]=[\underline{L}_s\ \underline{R}_s]U_0S_0^{-1/2} \tag{13}$$

The matrix $U_r$ can be chosen such that the best possible waveform match, in terms of minimal squared Euclidian distance, is obtained between the signals $\underline{L}_{0w}$ and $\underline{L}_{aw}$ and the signals $\underline{R}_{0w}$ and $\underline{R}_{aw}$, where $\underline{L}_{aw}$ and $\underline{R}_{aw}$ are given by (11). With this choice for $U_r$, a waveform match within the statistical method can be used.

From (12) it can be seen that the transformation matrix T is given by $$T=U_aS_a^{-1/2}U_rS_0^{1/2}U_0^H. \tag{14}$$

III. Best Waveform Match Under an Energy Constraint (Method III)

Assuming (3) the parameters $\alpha_1$, $\alpha_2$, $\beta_1$ and $\beta_2$ can be obtained by minimizing (4) and (5) under the energy constraints $$\sum_k \|L_s[k]\|^2 = \sum_k \|L_d[k]\|^2,\ \sum_k \|R_s[k]\|^2 = \sum_k \|R_d[k]\|^2. \tag{15}$$

IV. Mixing Method (Method IV)

As to mixing the different methods, possible combinations include mixing methods II.a and II.b, or mixing methods II.a and III. One can proceed as follows:

a) If the waveform match between $\underline{L}_s$ and $\underline{L}_d$ and between $\underline{R}_s$ and $\underline{R}_d$ that is obtained when using method II.b/III is good: use method II.b/III.

b) If this waveform match is poor, use method II.a.

c) Ensure a gradual transition between the two methods, by mixing their transformation matrices, as a function of the quality of this waveform match.

This can be expressed mathematically as follows:

Using (3) and (2) the transformation matrix T can be written in its general form as $$T=\begin{bmatrix}\alpha_1 & \alpha_2\\ \beta_1 & \beta_2\end{bmatrix}. \tag{16}$$

This matrix is rewritten using two vectors, $\underline{T}_L$ and $\underline{T}_R$, as follows $$T=[\,\underline{T}_L\ \ \underline{T}_R\,],\ \underline{T}_L=\begin{bmatrix}\alpha_1\\ \beta_1\end{bmatrix},\ \underline{T}_R=\begin{bmatrix}\alpha_2\\ \beta_2\end{bmatrix}. \tag{17}$$

The quality of the waveform match between $\underline{L}_s$ and $\underline{L}_d$ obtained by either using method II.b or method III, is expressed by $\gamma_L$. It is defined as $$\gamma_L=\max\left(0,\ \frac{\sum_k L_s[k]L_d^*[k]}{\sum_k \|L_s[k]\|\|L_d[k]\|}\right). \tag{18}$$

The quality of the waveform match between $\underline{R}_s$ and $\underline{R}_d$ obtained by either using method II.b or method III, is expressed by $\gamma_R$. It is defined as $$\gamma_R=\max\left(0,\ \frac{\sum_k R_s[k]R_d^*[k]}{\sum_k \|R_s[k]\|\|R_d[k]\|}\right). \tag{19}$$

Both $\gamma_L$ and $\gamma_R$ are between 0 and 1. The mixing coefficient of the left channel, $\delta_L$, and the mixing coefficient of the right channel, $\delta_R$, can be defined as follows:

$$\delta_L=\begin{cases}1 & \gamma_L>\mu_{L,max}\\ 0 & \gamma_L<\mu_{L,min}\\ \frac{1}{2}-\frac{1}{2}\cos\left(\pi\frac{(\gamma_L-\mu_{L,min})}{(\mu_{L,max}-\mu_{L,min})}\right) & \text{else,}\end{cases} \tag{20}$$

$$\delta_R=\begin{cases}1 & \gamma_R>\mu_{R,max}\\ 0 & \gamma_R<\mu_{R,min}\\ \frac{1}{2}-\frac{1}{2}\cos\left(\pi\frac{(\gamma_R-\mu_{R,min})}{(\mu_{R,max}-\mu_{R,min})}\right) & \text{else,}\end{cases}$$

wherein $\mu_{L,min}$, $\mu_{L,max}$, and $\mu_{R,max}$ are values between 0 and 1, $\mu_{L,min}<\mu_{L,max}$ and $\mu_{R,min}<\mu_{R,max}$. Equation (20) ensures that mixing the coefficients, $\delta_L$ and $\delta_R$, are between 0 and 1.

Define the transformation matrix T of method II.a, II.b and III, respectively, as $T_e$ which is given by (8), $T_a$, which is given by (14), and $T_{ce}$, respectively. Each transformation matrix can be split in two vectors, similar to the splitting of T in (17), as follows:

$$T_a=[\underline{T}_{a,L}\ \underline{T}_{a,R}],\ T_e=[\underline{T}_{e,L}\ \underline{T}_{e,R}],\ T_{ce}=[\underline{T}_{ce,L}\ \underline{T}_{ce,R}]. \tag{21}$$

The transformation matrix T for mixing method II.a and method II.b is obtained as $$T=[\underline{T}_L\ \underline{T}_R]=[\delta_L\underline{T}_{a,L}+(1-\delta_L)\underline{T}_{e,L}\ \delta_R\underline{T}_{a,R}+(1-\delta_R)\underline{T}_{e,R}]. \tag{22}$$

The transformation matrix T for mixing method II.a and method III is obtained as $$T=[\underline{T}_L\ \underline{T}_R]=[\delta_L\underline{T}_{ce,L}+(1-\delta_L)\underline{T}_{e,L}\ \delta_R\underline{T}_{ce,R}+(1-\delta_R)\underline{T}_{e,R}]. \quad (23)$$

Now, considering two auxiliary channels corresponding to two enhancement layer channels, Eq. (1) above may be rewritten as:

$$[\underline{L}_d\ \underline{R}_d]=[\underline{L}_a\ \underline{R}_a\ \underline{L}_{enh}\ \underline{R}_{enh}]T'. \quad (24)$$

where $\underline{L}_a$, $\underline{R}_a$ (as before) contain the samples of a time/frequency tile of the left and right channel of the artistic down-mix respectively, $\underline{L}_d$, $\underline{R}_d$ contain the samples of a time/frequency tile of the left and right channel of the modified artistic down-mix respectively and $\underline{L}_{enh}$, $\underline{R}_{enh}$ contain the samples of a time/frequency tile of the enhancement layer signals. The 4×2 transformation matrix T' thus describes the transformation from the artistic down-mix and the enhancement layer signals to the modified artistic down-mix. In relation to Eq. (1), the only two auxiliary channels used here are the enhancement layer signals $\underline{L}_{enh}$, $\underline{R}_{enh}$.

In the specific exemplary system, the second enhancement layer may contain two different types of data:

The first type of data comprises the parameters contained in matrix T of Eq. (1). These parameters are in the example calculated for the entire signal bandwidth and transform the artistic stereo down-mix such that it in some sense resembles the spatial down-mix. Thus, this type of parameters may provide a modified artistic down-mix which more closely resembles the original spatial down-mix but does not (necessarily) allow a decoder to exactly generate the spatial down mix. For each time/frequency tile only four parameters are required, namely the values of T are required (T11, T12, T21 and T22). These parameters can be coded either absolutely or differentially and the encoder 10 may specifically switch dynamically between the absolute and differential encoding.

The second type of data corresponds to the actual spatial down-mix and is in the specific example a representation of a band-limited version of the spatial down mix. Specifically, this type of data represents a low-frequency part of the spatial down-mix (e.g. frequencies below, say, 1.7 kHz) This makes it possible to very accurately reconstruct this part of the spatial down-mix at the decoder rather than just generating a signal which has the same, e.g. statistical, properties (as with matrix T). This type of data can be coded absolutely or relatively to the artistic down-mix. Specifically, this type of data can be differentially encoded. For example, the transformation matrix T is applied to the artistic down-mix (see e.g. Eq. (26)) and the difference of that signal and the spatial down-mix can be encoded.

Thus, in some embodiments the second enhancement data is divided into a first and second part of enhancement data wherein the first part describes the spatial down-mix less accurately than the second part. Typically, the corresponding data rate of the first part of the second enhancement data is lower than that of the second part. The enhancement data of the second part of the second enhancement data may relate to only a part of the down-mix and specifically may only relate to a low frequency part.

In some embodiments, the generator 123 may be arranged to select between absolute and relative data for both the first part and the second part of the second enhancement data either individually or together. In other embodiments, the generator 123 may only select between absolute and relative data for one of the parts of data. Specifically, in the following embodiments will be described wherein the first part of the second enhancement data comprises the parameters of T whereas the second the second part comprises a low-frequency representation of the spatial down-mix and the dynamic selection between absolute and relative data is only applied to the second part of the second enhancement data.

The relative data for the second part of the second enhancement data can in these embodiments e.g. be generated as differential values relative to the artistic down-mix after the enhancement data of the first part has been applied (i.e. as differential values relative to the modified artistic down-mix).

In the following, embodiments wherein the generator 123 selects only between relative and absolute data for the second part of the second enhancement data is described in the following.

Absolute enhancement data for part of the first and the second part of the second enhancement data can in this example be derived for the associated time/frequency tiles by setting:

$$\underline{L}_{enh}=\underline{L}_s,\quad \underline{R}_{enh}=\underline{R}_s,\quad T'=\begin{bmatrix}0&0\\0&0\\1&0\\0&1\end{bmatrix}, \quad (25)$$

where $\underline{L}_s$, $\underline{R}_s$ contain the samples of a time/frequency tile of the left and right channel of the spatial stereo down-mix respectively. Thus, in the specific example, the absolute enhancement data simply corresponds to the actual time/frequency tile samples of the spatial down-mix 102 which can replace the corresponding time/frequency tile samples of the artistic down-mix 103.

Furthermore, for the part of the first and the second part of the second enhancement data, relative enhancement data for the associated time/frequency tiles can specifically be derived as differential data by setting:

$$\underline{L}_{enh}=\underline{L}_s-T_{11}\underline{L}_a-T_{21}\underline{R}_a,\quad \underline{R}_{enh}=\underline{R}_s-T_{12}\underline{L}_a-T_{22}\underline{R}_a,\quad T'=\begin{bmatrix}T_{11}&T_{12}\\T_{21}&T_{22}\\1&0\\0&1\end{bmatrix}. \quad (26)$$

Here, the parameters $T_{11}$, $T_{12}$, $T_{21}$ and $T_{22}$ constitute the matrix T of Eq. (2):

$$T=\begin{bmatrix}T_{11}&T_{12}\\T_{21}&T_{22}\end{bmatrix}. \quad (27)$$

In this way, the generator 123 can generate both absolute enhancement data and relative enhancement data for the artistic down-mix 103 allowing a decoder to generate a modified artistic down-mix which more closely resembles the spatial down-mix 102 used for generating the multi-channel enhancement data.

The generator 123 is furthermore arranged to select between the absolute enhancement data and the relative enhancement data. This selection is in the specific example performed for individual signal blocks (e.g. individual segments) and based on characteristics of the signals within these signal blocks. Specifically, the generator 123 can evaluate characteristics of the absolute enhancement data and the relative enhancement data for a given signal block and can decide which data to include in the enhancement layer for the given signal block. In addition, the generator 123 can include an indication of which data was selected thereby allowing the decoder to apply the received enhancement data correctly.

In some embodiments, the generator 123 can evaluate the encoding to determine whether the absolute enhancement data or the relative enhancement data can be most efficiently encoded (e.g. with the lowest number of bits for a given accuracy). A brute force approach may be to actually encode both types of enhancement data and compare the encoded data size. However, this may be a complex approach in some embodiments, and in the exemplary encoder 10, the generator 123 evaluates the signal energy of the absolute enhancement data relative to the signal energy of the relative enhancement data and selects which type of data to include based on a comparison between the two.

Specifically, for audio coders it is often beneficial, in terms of the bit rate, to encode a signal with as small an energy as possible. Accordingly, the generator 123 selects the type of enhancement data which has the lowest signal energy. In particular, the relative enhancement data is selected when $$\|\underline{L}_s - T_{11}\underline{L}_a - T_{21}\underline{R}_a\|^2 + \|\underline{R}_s - T_{12}\underline{L}_a - T_{22}\underline{R}_a\|^2 < \|\underline{L}_s\|^2 + \|\underline{R}_s\|^2 \tag{28}$$

and otherwise the absolute enhancement data is selected.

A problem with switching between different enhancement data is that some noticeable artifacts may result. In the exemplary encoder 10, the generator 123 also comprises functionality for gradually switching between different enhancement data. Thus, instead of directly switching from one type of enhancement data in one signal block to another type in the next signal block, the switch is made gradual from one set of data to the other.

Thus, during a time interval (which may have a duration of less or more than one signal block), the generator 123 generates the enhancement data as a combination of the absolute enhancement data and the relative enhancement data. The combination may for example be achieved by an interpolation between the different types of data or may use an overlap and add technique.

As a specific example, instead of abruptly switching between the different types of enhancement data:

$$\underline{L}_{enh} = \underline{L}_s - T_{11}\underline{L}_a - T_{21}\underline{R}_a,\ \underline{R}_{enh} = \underline{R}_s - T_{12}\underline{L}_a - T_{22}\underline{R}_a \text{ or } \underline{L}_{enh} = \underline{L}_s,\ \underline{R}_{enh} = \underline{R}_s$$

the enhancement data which is transmitted can be generated as $$\underline{L}_{enh} = \underline{L}_s - \alpha T_{11}\underline{L}_a - \alpha T_{21}\underline{R}_a,\ \underline{R}_{enh} = \underline{R}_s - \alpha T_{12}\underline{L}_a - \alpha T_{22}\underline{R}_a, \tag{29}$$

where the value of $\alpha$ for the k-th data frame can be determined as:

$$\alpha_k = \begin{cases} \max(0, \alpha_{k-1} - \delta), & \text{if the current frame is absolutely coded,} \\ \min(1, \alpha_{k-1} + \delta), & \text{if the current frame is differentially coded,} \end{cases} \tag{30}$$

where $\alpha_k$ denotes the value of $\alpha$ in the k-th frame and $\delta$ is the adaptation speed. A value of $\delta$=0.33 can provide reliably artifact free encoding in many scenarios. The signals $\underline{L}_{enh}$ and $\underline{R}_{enh}$ given in Eq. (29) can be obtained using parameter interpolation or an overlap and add technique and are encoded and added to the bit-stream. In addition, the decision regarding differential or absolute enhancement data is included in the bit-stream, thereby making it possible for a decoder to derive the same value for $\alpha$ as is used in the encoder.

It will be appreciated that although the description focuses on using differential and absolute modes with (intra-channel) coding of each of these M-channels individually, other embodiments may use a different encoding approach. For example, for M=2, a next step may be to apply e.g. M/S coding (Mid/Side coding, hence coding the sum and the difference signal) when performing (inter-channel) coding of the stereo signal. In many embodiments this may be advantageous both in the differential and the absolute mode of (intra-channel) coding of the individual channels.

The elements of the transformation matrix T' may be real-valued or complex-valued. These elements may be encoded into modification parameters as follows: those elements of the transformation matrix T that are real and positive can be quantized logarithmically, like the IID parameters used in MPEG4 Parametric Stereo. It is possible to set an upper limit for the values of the parameters to avoid over-amplification of small signals. This upper limit can be either fixed or a function of the correlation between the automatically generated left channel and the artistic left channel and the correlation between the automatically generated right channel and the artistic right channel. Of the elements of T' that are complex, the magnitude can be quantized using HD parameters, and the phase can be quantized linearly. The elements of T' are real and possibly negative can be coded by taking the logarithm of the absolute value of an element, whilst ensuring a distinction between the negative and positive values.

Figure 6:
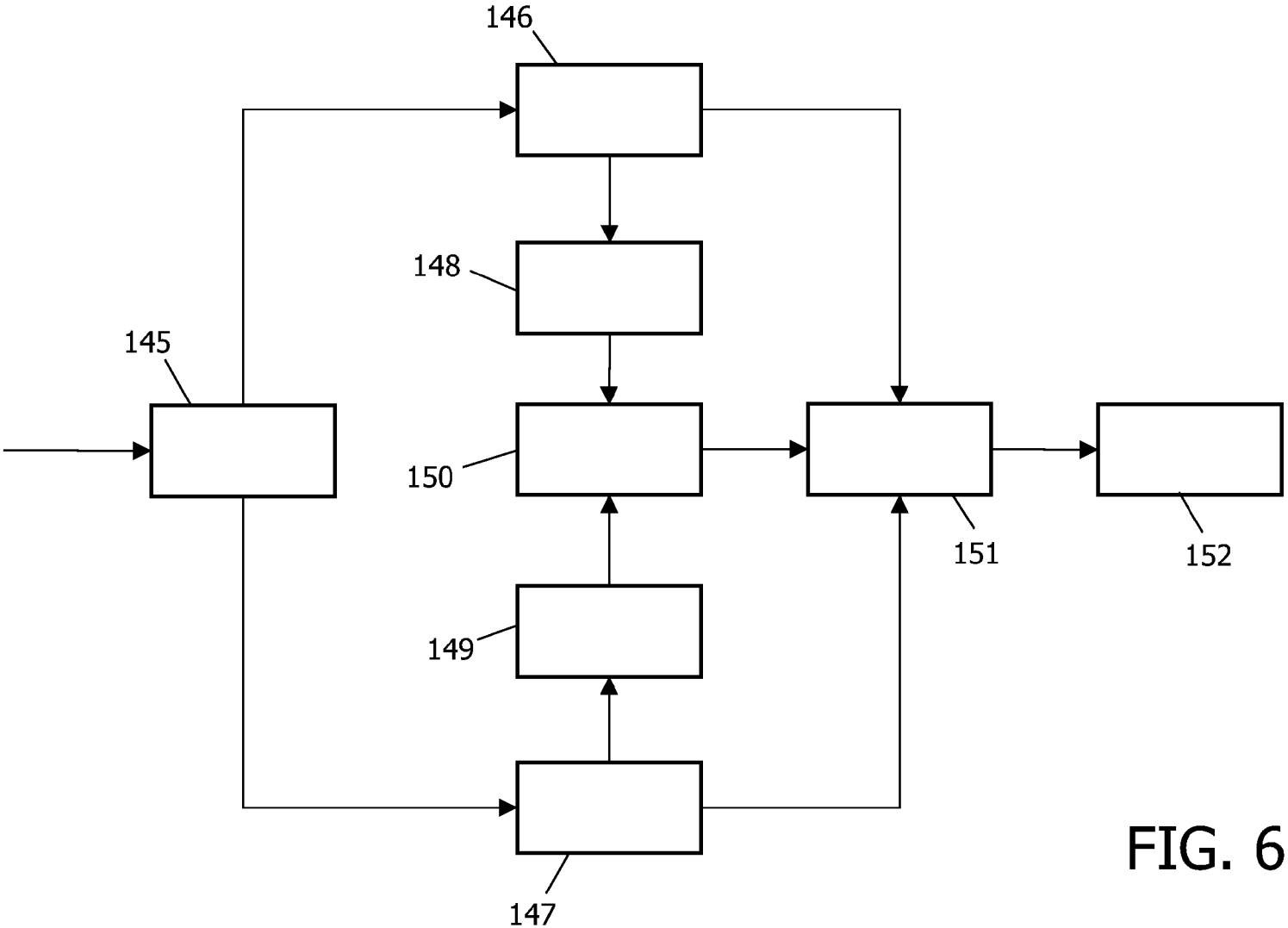
FIG. 6 shows a block diagram of an enhancement data generator according to some embodiments of the invention.

FIG. 6 illustrates an example of the generator 123 of FIG. 5 in more detail. In the example, the generator 123 comprises a signal block processor 145 which receives the frequency domain spatial and artistic down-mixes 102, 126 and divides the signals into signal blocks. Each signal block can correspond to a time interval of a predetermined duration. In some embodiments, signal blocks may alternatively or additionally be divided in the frequency domain and e.g. transform sub-channels may be grouped together in different signal blocks.

The signal block processor 145 is coupled to an absolute enhancement data processor 146 which generates the absolutate enhancement data for the individual signal blocks as previously described. In addition, the signal block processor 145 is coupled to a relative enhancement data processor 147 which generates the relative enhancement data for the individual signal blocks as previously described. The relative and absolute enhancement data is determined based on the signal characteristics within the signal block and specifically, the enhancement data for a given time/frequency tile group can be determined based only on that time/frequency tile group.

The absolute enhancement data processor 146 is coupled to a first signal energy processor 148 which determines the signal energy of the absolute enhancement data in each signal block as previously described. Similarly, the relative enhancement data processor 147 is coupled to a second signal energy processor 149 which determines the signal energy of the relative enhancement data in each signal block as previously described.

The first and second signal energy processors 148, 149 are coupled to a selection processor 150 which for each signal block selects either the absolute or relative enhancement data depending on which type has the lowest signal energy.

The selection processor 150 is fed to an enhancement data processor 151 which is furthermore coupled to the enhancement data processor 146 and the relative enhancement data processor 147. The selection processor 151 receives a control signal indicating which type of enhancement data has been selected and accordingly it generates the enhancement data as the selected enhancement data. Furthermore, the selection processor 151 is arranged to perform a gradual switch including an interpolation between the absolute and relative parameters during a switch time interval.

The selection processor 151 is coupled to an encode processor 152 which encodes the enhancement data in accordance with a given protocol. In addition, the encode processor 152 encodes data indicating which type of data is selected in each signal block, for example by setting a bit for each signal block to indicate the data type. The encoded data from the encode processor 152 is included in the encoded bit stream generated by the encoder 10.

Figure 7:
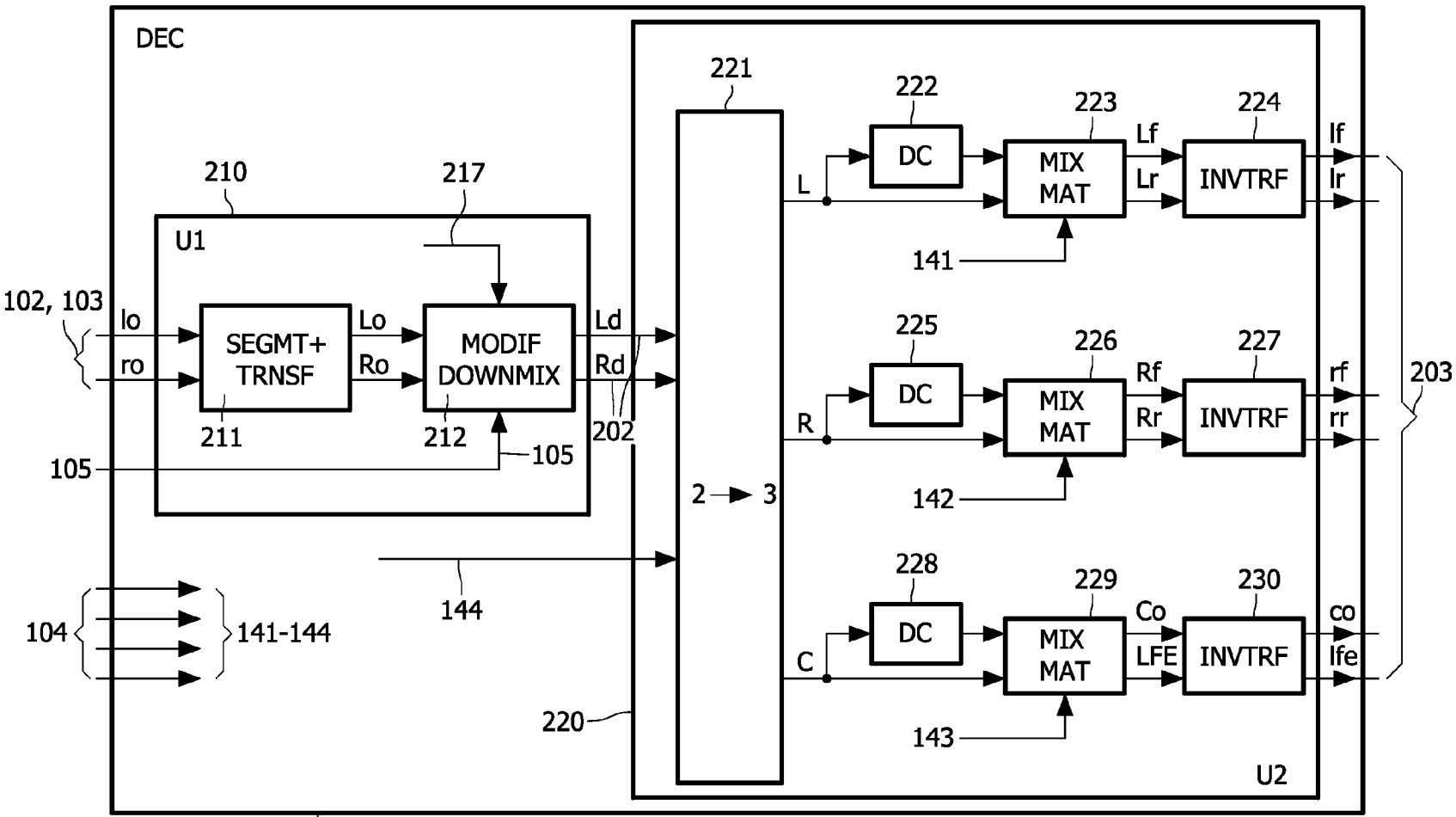
FIG. 7 shows a block diagram of a multi-channel audio decoder according to some embodiments of the invention.

FIG. 7 shows a block diagram of another embodiment of a multi-channel audio decoder according to some embodiments of the invention which specifically may be the audio decoder 20 of FIG. 2.

The decoder 20 comprises a first unit 210 and coupled thereto a second unit 220. The first unit 210 receives down-mix signals lo and ro and modification parameters 105 as inputs. The inputs may for example be received as a single bitstream from the encoder 10 of FIG. 1 or 5. The down-mix signals lo and ro may be part of a spatial down-mix 102 or an artistic down-mix 103.

The first unit 210 comprises a segmentation and transformation unit 211 and a down-mix modification unit 212. The down-mix signals lo and ro, respectively, are segmented and the segmented signals are transformed to the frequency domain in segmentation and transformation unit 211. The resulting frequency domain representations of the segmented down-mix signals are shown as frequency domain signals Lo and Ro, respectively. Next, the frequency domain signals Lo and Ro are processed in the down-mix modification unit 212. The function of this down-mix modification unit 212 is to modify the input down-mix such that it resembles the spatial down-mix 202, i.e. to reconstruct the spatial down-mix 202 from the artistic down-mix 103 and the modification parameters 105.

If the spatial down-mix 102 is received by the decoder 20 the down-mix modification unit 212 does not have to modify the down-mix signals Lo and Ro and these down-mix signals Lo and Ro can simply be passed on to the second unit 220 as down-mix signals Ld and Rd of spatial down-mix 202. A control signal 217 may indicate whether there is a need for modification of the input down-mix, i.e. whether the input down-mix is a spatial down-mix or an alternative down-mix. The control signal 217 may be generated internally in the decoder 20, e.g. by analyzing the input down-mix and the associated parameters 105 which may describe signal properties of the desired spatial down-mix. If the input down-mix matches the desired signal properties the control signal 217 may be set to indicate that there is no need for modification. Alternatively, the control signal 217 may be set manually or its setting may be received as part of the encoded multi-channel audio signal, e.g. in parameter set 105.

If the encoder 20 receives the artistic down-mix 103 and the control signal 217 indicates that the received down-mix signals Lo and Ro are to be modified by the down-mix modification unit 212 then the decoder can operate in two ways, depending on the representation of the received modification parameters. If the parameters represent the relative transformation from the artistic down-mix to the spatial down-mix (i.e. if the parameters is relative enhancement data), the transformation variables are obtained directly by applying the modification parameters to the artistic down-mix in inverse to the operation performed in the encoder. In different embodiments, this may for example be applied to the second part of the second enhancement data of the only.

On the other hand, if the transmitted parameters represent absolute properties of the spatial down-mix, the decoder can directly replace the artistic down-mix samples by the spatial down-mix samples. For example, if the second part of the second enhancement data simply consists in the time/frequency tile samples of the spatial down-mix, the decoder can directly replace the corresponding time/frequency tile samples of the artistic down-mix by these. It will be appreciated that it is also possible for the decoder to first compute the corresponding properties of the actually transmitted artistic down-mix. Using this information (transmitted parameters and computed properties of the transmitted artistic down-mix), the transformation variables are then determined that describe the transform from (properties of) the transmitted artistic down-mix to (properties of) the spatial down-mix. To be more specific, transformation matrix T can be determined using either method II.a or (a slightly modified) II.b that were previously described.

Method II.a can be used if absolute energies are transmitted in the first part of the second enhancement data. The transmitted (absolute) parameters, $E_{Ls}$ and $E_{Rs}$, represent the energy of the left and right signal of the spatial down-mix respectively and are given by $$E_{L_0} = \sum_k \|L_s[k]\|^2,\ E_{R_0} = \sum_k \|R_s[k]\|^2. \tag{31}$$

The energies of the transmitted down-mix, $E_{DLs}$ and $E_{Drs}$, are computed at the decoder. Using these variables we can compute the parameters α and β of (7), as follows $$\alpha = \sqrt{\frac{E_{L_s}}{E_{DL_s}}},\ \beta = \sqrt{\frac{E_{R_s}}{E_{DR_s}}}. \tag{32}$$

Transformation matrix T is given by $$T = \begin{bmatrix} \alpha & 0 \\ 0 & \beta \end{bmatrix}. \tag{33}$$

Specifically, the down-mix modification unit 212 comprises functionality for extracting the artistic down-mix and the modification parameters 105 from the received bitstream. The artistic down-mix is divided into signal blocks (corresponding to the signal blocks used by the decoder). For each signal block the down-mix modification unit 212 evaluates the received data indication of the bitstream to determine if relative or absolute second enhancement data is provided for the first and for the second part for this signal block. The down-mix modification unit 212 then applies the first and the second part of the second enhancement data as absolute enhancement data or relative enhancement data in response to the indication data.

It has been found that low complexity but high performance can be achieved when the transformation matrix elements $T_{12}$ and $T_{21}$ are set to zero. In the following, some specific implementations of the down-mix modification unit 212 are described with this restriction. However, it will be appreciated that the implementations can easily be extended to the case when $T_{12}$ and/or $T_{21}$ are different than zero.

Figure 8:
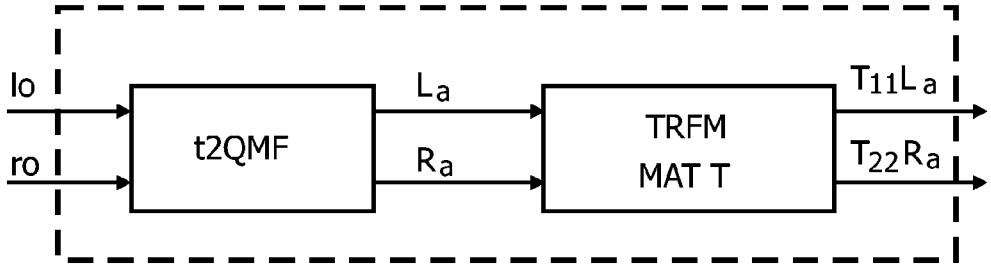
FIG. 8 shows a block diagram of elements of a multi-channel audio decoder.

In the case where no enhancement data of the second part of the second enhancement data is transmitted for the artistic down-mix signal, the first unit 210 can be implemented as shown in FIG. 8. The time domain stereo down-mix channels, lo and ro, are first segmented and transformed to the frequency domain by a QMF transformation, resulting in the signals $L_a$ and $R_a$, representing a time/frequency tile of the artistic stereo down-mix. Next, these signals are transformed using the transformation matrix T, resulting in the signals $T_{11}L_a$ and $T_{22}R_a$.

It will be appreciated that the enhancement data can be generated and applied in the time and/or frequency domain. Thus, it is possible to include the coded time domain enhancement data ($L_{enh}$, $R_{enh}$) in the bit-stream. However, in some applications it can be advantageous to include the coded frequency domain enhancement data rather than the time domain enhancement data. For example, in many encoders the enhancement data is generated in the frequency domain for time/frequency tiles and in order to generate the time domain signal, a frequency to time domain transformation is required at the encoder. Furthermore, in order to apply such enhancement data, the decoder converts the data from the time domain to the frequency domain. The domain conversions can thus be reduced by including the enhancement data in the frequency domain.

In some embodiments, different time to frequency conversions may be used for generating the artistic down-mix and the enhancement data. For example, the encoding of the artistic down-mix can use a QMF transform whereas the enhancement data uses a MDCT transform. In this case, the enhancement data may be included in the (MDCT) frequency domain and a transform directly between the two frequency domains can be performed by the down-mix modification unit 212 as illustrated in FIG. 9.

In the example, the transformation matrix T* can simply be the transformation matrix T of Eq. (2). However, in order to reduce switching artifacts T* can correspond to the transformation matrix T of Eq. (2) but modified for a gradual switch. Specifically, the matrix T* can include the factor $\alpha$ as determined by Eq. (30), where the decision regarding absolute or relative enhancement data is retrieved from the bit-stream. This scheme is used for those signal blocks/frequency bands where the enhancement layer data of the second part of the second enhancement data is present and otherwise the approach of FIG. 8 can be used.

Figure 9:
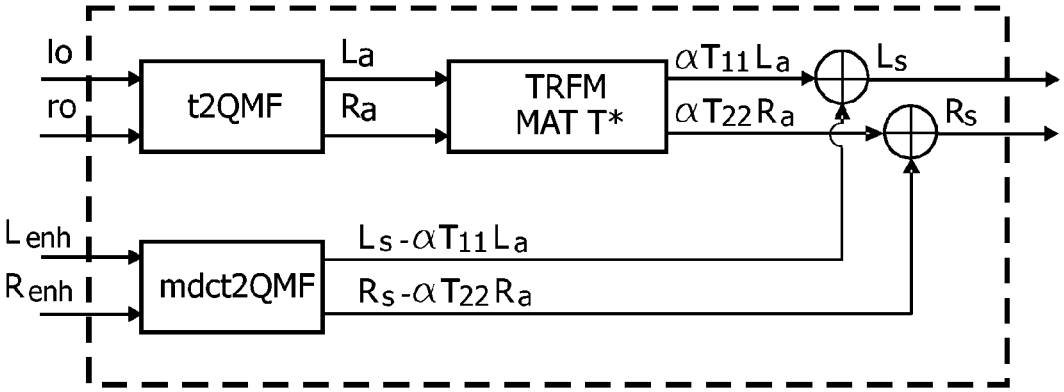
FIG. 9 shows a block diagram of elements of a multi-channel audio decoder according to some embodiments of the invention.
Figure 10:
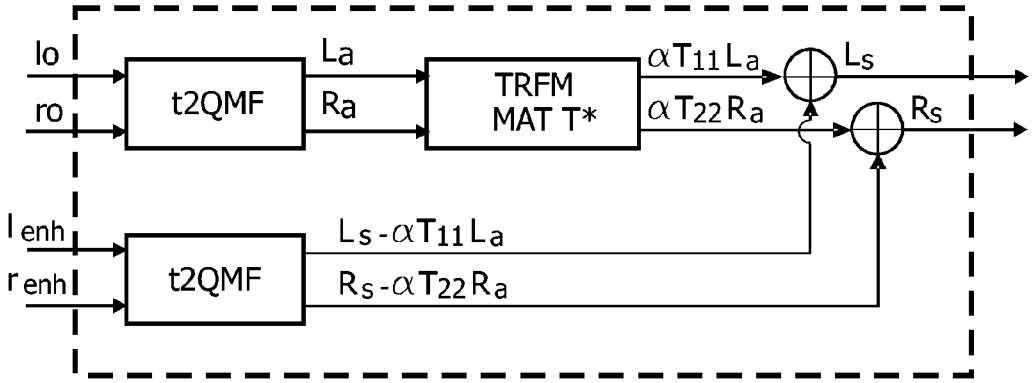
FIG. 10 shows a block diagram of elements of a multi-channel audio decoder according to some embodiments of the invention.

If the enhancement data ($L_{enh}$, $R_{enh}$) is provided in the time domain, a similar approach to that of FIG. 9 can be used as illustrated in FIG. 10. However, in this case the frequency to frequency transformation is replaced by a time to frequency transformation which specifically can be by a time to QMF domain transform when QMF transforms are used for encoding the artistic down-mix. Thus, in this example, the enhancement data is applied in the frequency domain.

In many embodiments, a decoder implementation for time domain enhancement data which only uses one time to frequency domain transform in the first unit 210 can be used.

Specifically, the following differential enhancement data parameters can be used:

$$\underline{L}_{enh} = \frac{T_{22}\underline{L}_s - T_{21}\underline{R}_s}{\det(T)} - \underline{L}_a, \quad \underline{R}_{enh} = \frac{-T_{12}\underline{L}_s + T_{11}\underline{R}_s}{\det(T)} - \underline{R}_a, \quad T' = \begin{bmatrix} 1 & 0 \\ 0 & 1 \\ 1 & 0 \\ 0 & 1 \end{bmatrix}, \tag{34}$$

provided that matrix T, given by Eq. (27), is non-singular (hence its inverse exists). Now Eq. (1) can be changed to:

$$[\underline{L}_d\ \underline{R}_d] = [\underline{L}_a\ \underline{R}_a\ \underline{L}_{enh}\ \underline{R}_{enh}]T'T. \tag{35}$$

Figure 11:
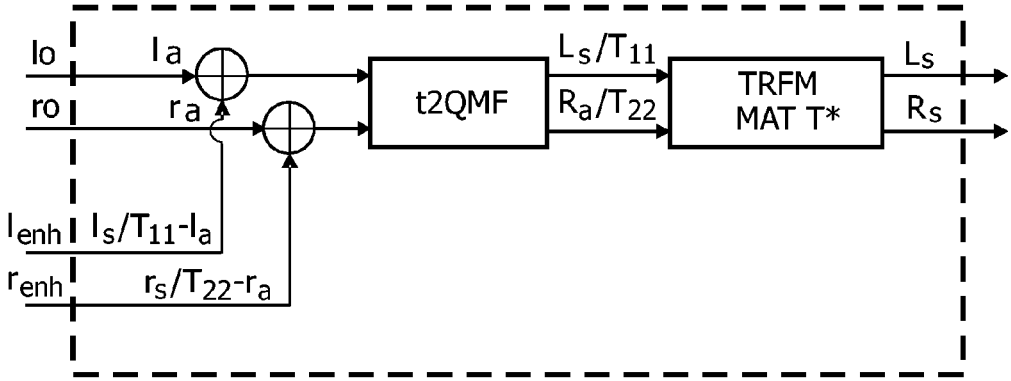
FIG. 11 shows a block diagram of elements of a multi-channel audio decoder according to some embodiments of the invention.

FIG. 11 illustrates an efficient implementation of the down-mix modification unit 212 for time domain enhancement data based on Eq. (34) and (35) is provided. For clarity, $T_{12}$ and $T_{21}$ of the matrix T are set to zero. In comparison to the implementation of FIG. 10, only one time to QMF domain transform is required by the implementation of FIG. 11.

Thus, as described above the down-mix modification unit 212 generates a signal 202 which very closely resembles the spatial down-mix used for the multi-channel enhancement data. This may effectively be used by the second unit 220 to expand the two channel audio signal to a full surround sound multi-channel signal. Furthermore, by dynamically and flexibly selecting the most appropriate type of enhancement data (relative or absolute) for each signal block, a substantially more efficient encoding is achieved and a multi-channel encoding/decoding with an improved quality to data rate ratio is achieved.

The second unit 220 can be a conventional 2-to-5.1 multi-channel decoder which decodes the reconstructed spatial down-mix 202 and the associated parametric data 104 into a 5.1 channel output signal 203. As described before, the parametric data 104 comprise parametric data 141, 142, 143 and 144. The second unit 220 performs the inverse processing of the first unit 110 in the encoder 10. The second unit 220 comprises an up-mixer 221, which converts the stereo down-mix 202 and associated parameters 144 into three mono audio signals L, R and C. Next, each of the mono audio signals L, R and C, respectively, are de-correlated in de-correlators 222, 225 and 228, respectively. Thereafter, a mixing matrix 223 transforms the mono audio signal L, its de-correlated counterpart and associated parameters 141 into signals Lf and Lr. Similarly, a mixing matrix 226 transforms the mono audio signal R, its de-correlated counterpart and associated parameters 142 into signals Rf and Rr, and a mixing matrix 229 transforms the mono audio signal C, its de-correlated counterpart and associated parameters 143 into signals Co and LFE. Finally, the three pairs of segmented frequency-domain signals Lf and Lr, Rf and Rf, Co and LFE, respectively, are transformed to the time-domain and combined by overlap-add in inverse transformers 224, 227 and 230, respectively to obtain three pairs of output signals lf and lr, rf and rr, and co and lfe, respectively. The output signals lf, lr, rf, rr, co and lfe form the decoded multi-channel audio signal 203.

The multi-channel audio encoder 10 and the multi-channel audio decoder 20 may be implemented by means of digital hardware or by means of software which is executed by a digital signal processor or by a general purpose microprocessor.

It will be appreciated that the above description for clarity has described embodiments of the invention with reference to different functional units and processors. However, it will be apparent that any suitable distribution of functionality between different functional units or processors may be used without detracting from the invention. For example, functionality illustrated to be performed by separate processors or controllers may be performed by the same processor or controllers. Hence, references to specific functional units are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements or method steps may be implemented by e.g. a single unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. A multi-channel audio encoder for encoding an N-channel audio signal, the multi-channel audio encoder comprising:

a down-mixer, coupled to receive the N-channel audio signal, for generating a first M-channel signal, M being smaller than N;

an encoder, also coupled to receive said N-channel audio signal, for generating first enhancement data for the first M-channel signal relative to the N-channel audio signal;

means for generating a second M-channel signal for the N-channel audio signal;

a generator coupled to receive the first M-channel signal and the second M-channel signal for generating second enhancement data for the second M-channel signal relative to the first M-channel signal; and an output for supplying an encoded output signal comprising the second M-channel signal, the first enhancement data and the second enhancement data, wherein the generator dynamically selects between generating the second enhancement data as absolute enhancement data or as relative enhancement data relative to the second M-channel signal.

2. The multi-channel audio encoder as claimed in claim 1, wherein the generator selects between the absolute enhancement data and the relative enhancement data in response to a characteristic of the N-channel signal.

3. The multi-channel audio encoder as claimed in claim 1, wherein the generator selects between the absolute enhancement data and the relative enhancement data in response to a relative characteristic of the absolute enhancement data and the relative enhancement data.

4. The multi-channel audio encoder as claimed in claim 3, wherein the relative characteristic is a signal energy of the absolute enhancement data relative to a signal energy of the relative enhancement data.

5. The multi-channel audio encoder as claimed in claim 1 wherein the generator divides the second M-channel signal into signal blocks and individually selects between the absolute enhancement data and the relative enhancement data for each signal block.

6. The multi-channel audio encoder as claimed in claim 5, wherein the generator selects between the absolute enhancement data and the relative enhancement data for a signal block based only on characteristics associated with the signal block.

7. The multi-channel audio encoder as claimed in claim 1, wherein the generator generates the enhancement data as a combination of the absolute enhancement data and the relative enhancement data during a switch time interval of a switch between generating the enhancement data as absolute enhancement data and as relative enhancement data.

8. The multi-channel audio encoder as claimed in claim 7, wherein the combination comprises an interpolation between the absolute enhancement data and the relative enhancement data.

9. The multi-channel audio encoder as claimed in claim 1, wherein the means for generating the encoded output signal includes, in the encoded output signal, indication data indicating if relative enhancement data or absolute enhancement data is used.

10. The multi-channel audio encoder as claimed in claim 1, wherein the second enhancement data comprises a first part of enhancement data and a second part of enhancement data, the second part providing a higher quality representation of the first M-channel signal than the first part.

11. The multi-channel audio encoder as claimed in claim 10, wherein the generator dynamically selects only between generating the second part as absolute enhancement data or as relative enhancement data.

12. The multi-channel audio encoder as claimed in claim 10, wherein the generator generates relative data of the second part relative to a reference signal generated by applying enhancement data of the first part to the first M-channel signal.

13. A multi-channel audio decoder for decoding an N-channel audio signal, the multi-channel audio decoder comprising:

a receiver for receiving an encoded audio signal comprising:

a first M-channel signal for the N-channel audio signal, M being smaller than N, first enhancement data for multi-channel expansion, the first enhancement data being relative to a second M-channel signal different than the first M-channel signal, second enhancement data for the first M-channel signal relative to the second M-channel signal, the second enhancement data comprising absolute enhancement data and relative enhancement data relative to the first M-channel signal, and indication data indicative of whether the second enhancement data for a signal block is absolute enhancement data or relative enhancement data;

a down-mix modification unit for generating an M-channel multi-channel expansion signal in response to the first M-channel signal and the second enhancement data; and means for generating an N-channel decoded signal in response to the M-channel multi-channel expansion signal and the first enhancement data, wherein the down-mix modification unit selects between applying the second enhancement data as absolute enhancement data or relative enhancement data in response to the indication data.

14. The multi-channel audio decoder as claimed in claim 13, wherein the down-mix modification unit applies the second enhancement data to the first M-channel signal in the time domain.

15. The multi-channel audio decoder as claimed in claim 13, wherein the down-mix modification unit applies the second enhancement data to the first M-channel signal in the frequency domain.

16. The multi-channel audio decoder as claimed in claim 13, wherein the second enhancement data comprises a first part of enhancement data and a second part of enhancement data, the second part providing a higher quality representation of the first M-channel signal than the first part.

17. The multi-channel audio decoder as claimed in claim 13, wherein the down mix modification unit only selects between applying second enhancement data of the second part as absolute enhancement data or relative enhancement data.

18. The multi-channel audio decoder as claimed in claim 13 wherein down-mix modification unit generates the M-channel multi-channel expansion by applying relative enhancement data of the second part to a signal generated by applying enhancement data of the first part to the first M-channel signal.

19. A method of encoding an N-channel audio signal, the method comprising the steps of:

generating a first M-channel signal for the N-channel audio signal, M being smaller than N;

generating first enhancement data for the first M-channel signal relative to the N-channel audio signal;

generating a second M-channel signal for the N-channel audio signal;

generating second enhancement data for the second M-channel signal relative to the first M-channel signal; and generating an encoded output signal comprising the second M-channel signal, the first enhancement data and the second enhancement data, wherein the generation of the second enhancement data comprises dynamically selecting between generating the second enhancement data as absolute enhancement data or as relative enhancement data relative to the second M-channel signal.

20. A method of decoding an N-channel audio signal, the method comprising the steps of:

receiving an encoded audio signal comprising:

a first M-channel signal for the N-channel audio signal, M being smaller than N, first enhancement data for multi-channel expansion, the first enhancement data being relative to a second M-channel signal different than the first M-channel signal, second enhancement data for the first M-channel signal relative to the second M-channel signal, the second enhancement data comprising absolute enhancement data and relative enhancement data relative to the first M-channel signal, and indication data indicative of whether the second enhancement data for a signal block is absolute enhancement data or relative enhancement data;

generating an M-channel multi-channel expansion signal in response to the first M-channel signal and the second enhancement data; and generating an N-channel decoded signal in response to the M-channel multi-channel expansion signal and the first enhancement data, wherein the generation of the M-channel multi-channel expansion signal comprises selecting between applying the second enhancement data as absolute enhancement data or relative enhancement data in response to the indication data.

21. A non-transitory computer-readable medium having stored thereon an encoded multi-channel audio signal generated from an N-channel audio signal, said encoded multi-channel audio signal comprising: M-channel signal data generated from an N-channel audio signal, M being smaller than N; first enhancement data for multi-channel expansion, the first enhancement data being relative to a second M-channel signal different than the first M-channel signal; second enhancement data for the first M-channel signal relative to the second M-channel signal, the second enhancement data comprising absolute enhancement data and relative enhancement data relative to the first M-channel signal; and indication data indicative of whether the second enhancement data for a signal block is absolute enhancement data or relative enhancement data.

22. A transmitter for transmitting an encoded multi-channel audio signal, the transmitter comprising a multi-channel audio encoder as claimed in claim 1.

23. A receiver for receiving a multi-channel audio signal, the receiver comprising a multi-channel audio decoder as claimed in claim 13.

24. A transmission system comprising a transmitter for transmitting an encoded multi-channel audio signal via a transmission channel to a receiver, the transmitter comprising a multi-channel audio encoder as claimed in claim 1, and the receiver comprising a multi-channel audio decoder for decoding an N-channel audio signal, the multi-channel audio decoder comprising:

a receiver for receiving an encoded audio signal comprising:

a first M-channel signal for the N-channel audio signal, M being smaller than N, first enhancement data for multi-channel expansion, the first enhancement data being relative to a second M-channel signal different than the first M-channel signal, second enhancement data for the first M-channel signal relative to the second M-channel signal, the second enhancement data comprising absolute enhancement data and relative enhancement data relative to the first M-channel signal, and indication data indicative of whether the second enhancement data for a signal block is absolute enhancement data or relative enhancement data;

a down-mix modification unit for generating an M-channel multi-channel expansion signal in response to the first M-channel signal and the second enhancement data; and means for generating an N-channel decoded signal in response to the M-channel multi-channel expansion signal and the first enhancement data, wherein the down-mix modification unit selects between applying the second enhancement data as absolute enhancement data or relative enhancement data in response to the indication data.

25. A method of transmitting an encoded multi-channel audio signal, the method comprising encoding an N-channel audio signal, wherein the encoding comprises:

generating a first M-channel signal for the N-channel audio signal, M being smaller than N;

generating first enhancement data for the first M-channel signal relative to the N-channel audio signal;

generating a second M-channel signal for the N-channel audio signal;

generating second enhancement data for the second M-channel signal relative to the first M-channel signal; and generating an encoded output signal comprising the second M-channel signal, the first enhancement data and the second enhancement data, wherein the generation of the second enhancement data comprises dynamically selecting between generating the second enhancement data as absolute enhancement data or as relative enhancement data relative to the second M-channel signal.

26. A method of receiving an encoded multi-channel audio signal, the method comprising decoding the encoded multi-channel audio signal, the decoding comprising:

receiving the encoded multi-channel audio signal comprising:

a first M-channel signal for the N-channel audio signal, M being smaller than N, first enhancement data for multi-channel expansion, the first enhancement data being relative to a second M-channel signal different than the first M-channel signal, second enhancement data for the first M-channel signal relative to the second M-channel signal, the second enhancement data comprising absolute enhancement data and relative enhancement data relative to the first M-channel signal, and indication data indicative of whether the second enhancement data for a signal block is absolute enhancement data or relative enhancement data;

generating an M-channel multi-channel expansion signal in response to the first M-channel signal and the second enhancement data; and generating an N-channel decoded signal in response to the M-channel multi-channel expansion signal and the first enhancement data, wherein the generation of the M-channel multi-channel expansion signal comprises selecting between applying the second enhancement data as absolute enhancement data or relative enhancement data in response to the indication data.

27. A method of transmitting and receiving an audio signal, the method comprising:

encoding an N-channel audio signal, wherein the encoding comprises:

generating a first M-channel signal for the N-channel audio signal, M being smaller than N, generating first enhancement data for the first M-channel signal relative to the N-channel audio signal, generating a second M-channel signal for the N-channel audio signal, generating second enhancement data for the second M-channel signal relative to the first M-channel signal, the generation of the second enhancement data comprising dynamically selecting between generating the second enhancement data as absolute enhancement data or as relative enhancement data relative to the second M-channel signal, and generating an encoded output signal comprising the second M-channel signal, the first enhancement data and the second enhancement data;

transmitting the encoded output signal from a transmitter to a receiver;

receiving, at the receiver, the encoded output signal; and decoding the encoded output signal wherein the decoding comprises:

generating an M-channel multi-channel expansion signal in response to the second M-channel signal and the second enhancement data, the generation of the M-channel multi-channel expansion signal comprising selecting between applying the second enhancement data as absolute enhancement data or relative enhancement data, and generating an N-channel decoded signal in response to the M-channel multi-channel expansion signal and the first enhancement data.

28. A non-transitory computer-readable storage medium having recorded thereon a computer program operative to cause a processor, when executing the computer program, to perform the steps of the method as claimed in claim 19.

29. A multi-channel audio recorder comprising a multi-channel audio encoder as claimed in claim 1.

30. A multi-channel audio player comprising a multi-channel audio decoder as claimed in claim 13.

* * * * *